US006880818B2

(12) United States Patent
Desaulniers et al.

(10) Patent No.: US 6,880,818 B2
(45) Date of Patent: Apr. 19, 2005

(54) FLYLESS STREAM SHINGLING AND STREAM MERGING APPARATUS AND METHOD

(76) Inventors: Edward Desaulniers, 310 St-Lambert, Quebec (CA), J4P 1H8; John Lovaghy, 96 Napoleon, Mascouche, Quebec (CA), J7L 3B2; Robert Classen, General Delivery, Winchester, VA (US) 22601

( * ) Notice: Subject to any disclaimer, the term of this patent is extended or adjusted under 35 U.S.C. 154(b) by 94 days.

(21) Appl. No.: 10/351,808

(22) Filed: Jan. 24, 2003

(65) Prior Publication Data

US 2004/0145108 A1 Jul. 29, 2004

(51) Int. Cl.[7] ..... B42B 2/00; B42B 2/02; B65H 39/00; B65H 39/02; B65H 41/00

(52) U.S. Cl. ..... 270/52.14; 412/9

(58) Field of Search ..... 270/52.14; 412/9

(56) References Cited

U.S. PATENT DOCUMENTS 5,833,226 A * 11/1998 Claassen ..... 270/52.16
6,095,511 A * 8/2000 Jager ..... 270/52.29
6,158,735 A * 12/2000 Cote et al. ..... 271/302

FOREIGN PATENT DOCUMENTS

CA 2 314 515 * 1/2002 ..... B65H/39/06

* cited by examiner

*Primary Examiner*—Donald P. Walsh
*Assistant Examiner*—Kenneth W Bower
(74) *Attorney, Agent, or Firm*—Eric Fincham

(57) ABSTRACT

An apparatus which can shingle a series of products and a method relating thereto, the apparatus, in one embodiment, having first upper and lower moving surfaces to receive a product, a second upper moving surface at an exit end of the first moving surfaces, the second upper surface being angled downwardly, a deflector to deflect the leading edge of the product moving along the second upper moving surface, and a second lower moving surface located below the deflector to receive a product. The device provides a positive control for the product and eliminates the use of delivery fan (fly) systems. Also provided are devices to reform various combinations of copies as used in the printing industry.

1 Claim, 10 Drawing Sheets

Lower Merger Section
Without side wall
Exibiting Two Point Delivery System

Figure 1
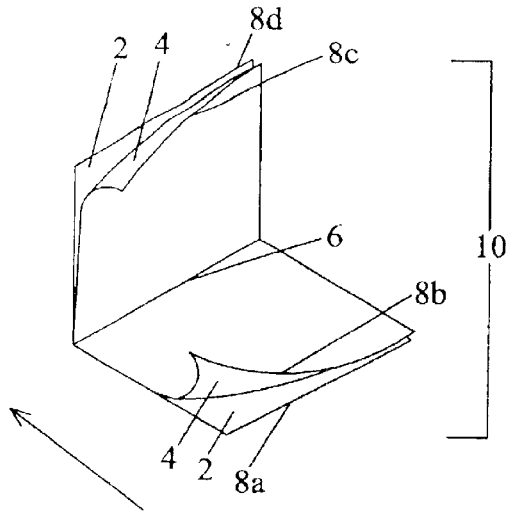
Figure 1A -
A half-fold book
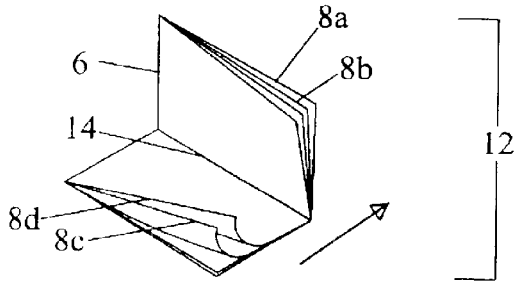
Figure 1B -
A quarter-fold book
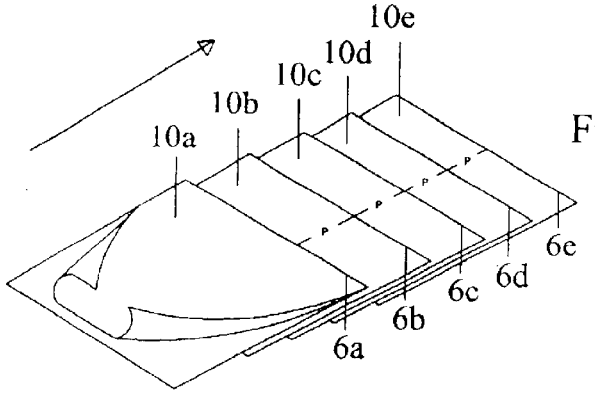
Figure 1C -
A single shingled stream
of half-folded books
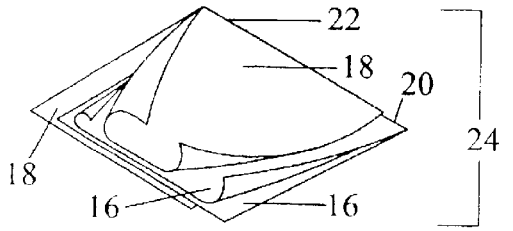
Figure 1D -
A single set of
nested books Std Folder Machine Side View Std Folder Machine Top View Plastic support plates Plastic support plates Stream 1 & 2 "Out"
Stream path 1 "In"
Stream path 2 "In"
Point 60
Point 65
Point 70
Point 80
160
120
121
128
126
81
83
122
121
98
86

Turn -table of the Lower- Merger Section 130

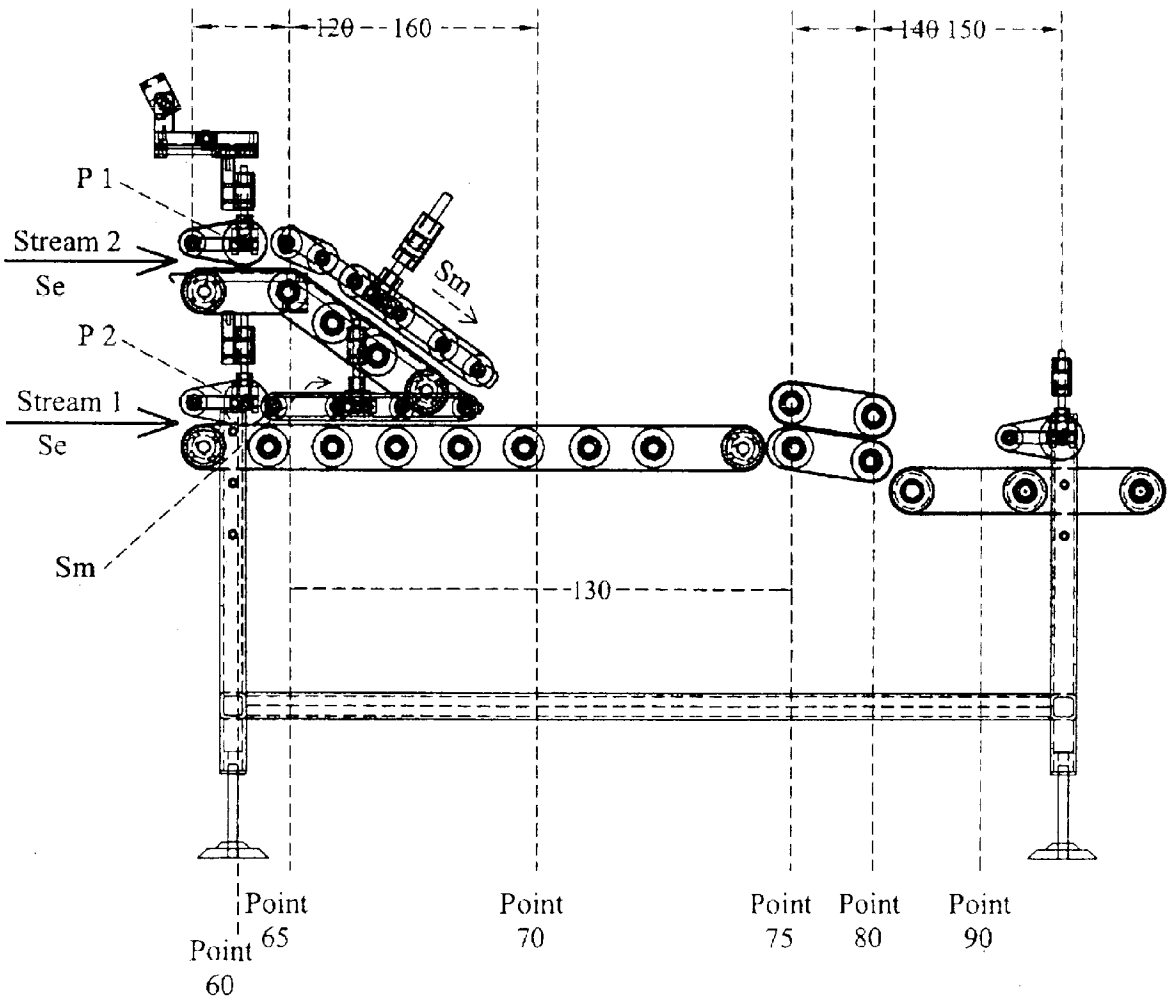
Figure 6 - Above and Below Stream Merging

Figure 7a - Top View
One Point (or two) Stream Desertion for Nested Books
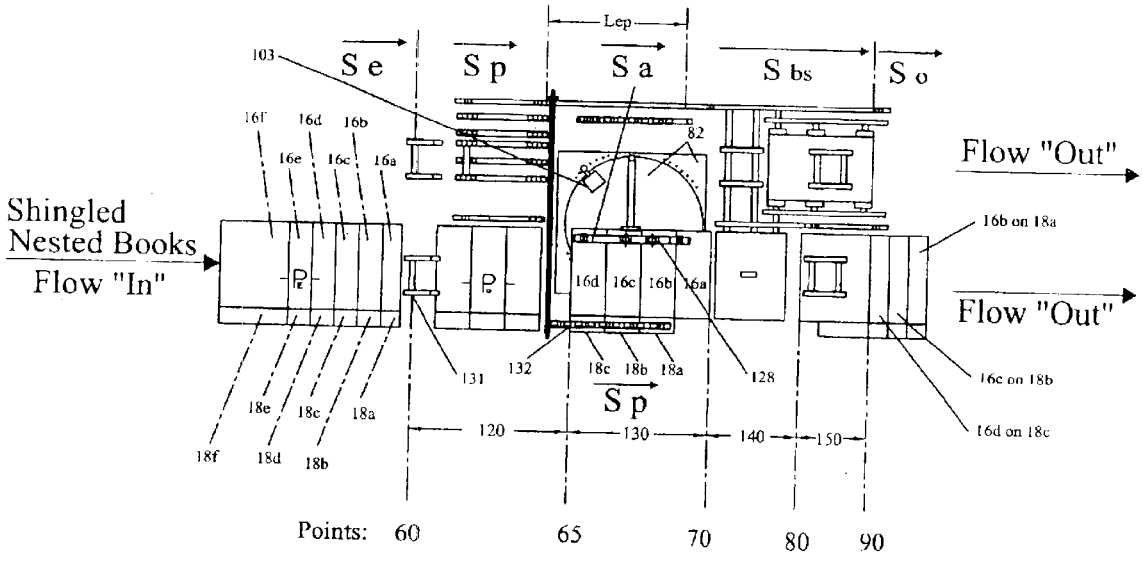
Figure 7b - Side View
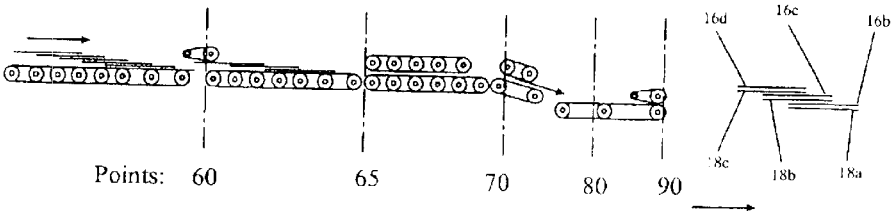

Flyless Web Press Shingling System

Book- Separator and Flyless Shingler Section

Lower Merger Section
Without side wall
Exibiting Two Point Delivery System

Figure 11
Lower Merger Section
As a Stand- alone Two Point Deserter
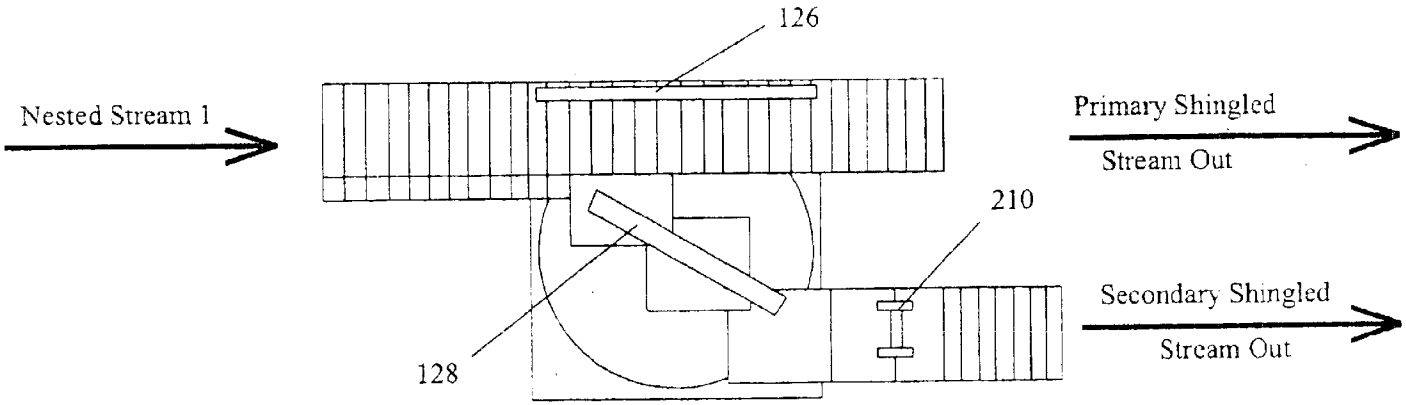
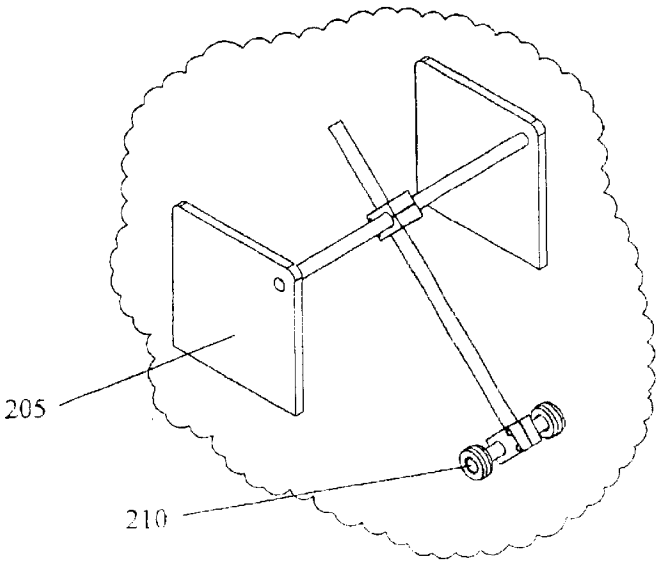
Figure 11a

FLYLESS STREAM SHINGLING AND STREAM MERGING APPARATUS AND METHOD

FIELD OF THE INVENTION

The present invention relates to an apparatus and method for shingling and streaming to eliminate the delivery fan fly system associated with rotary web printing presses.

BACKGROUND OF THE INVENTION

Paradoxically, shingling of streams to this very day, and after many decades, is seen as a fundamentally important "inline" process for web printing which is almost always accomplished as the final operation of conventional "inline" folder machines. While it is unclear why it is that shingling gained such pre-eminence, it seems that shingling started out decades ago as a means to handle increased production seeds. After all, a single-file stream spaced by a copy's width typically travels at a surface speed that are six times higher, or more, than shingled copies with a two-inch shingle pitch. As the years passed, the evolution of folders, trimmers and stackers assumed that the incoming stream of copies to be processed would be shingled. Further, the shingling apparatus of preference is a sub-assembly section of conventional folder machines, called a fly shingling apparatus (also called a fan or spider or star delivery system). The fly is an entrenched industry standard even though it is heavily reliant on precise mechanical timing such that it contributes to lower production speeds which can be as low as 50% of the design speeds of the web press which it serves. As a result of fly shingling and its historic importance to the web printing process, inline folder machines, and other finishing equipment such as trimmers and stackers, are designed around the accepted idea that stream shingling was a mandatory processing step in web printing and that shingling was necessarily done at the folder machine. However, U.S. Pat. No. 5,833,226 issued Nov. 10, 1998 entitled "Inline Deserter and Integrator Apparatus and Method" assigned to the same assignee as the present invention broke with this convention of fly shingling at the folder machine by introducing a method of shingling without its mechanical timing proclivities and without it being necessary to perform this shingling at the folder machine. This prior art was the first step taken towards shingling as a distinct and separate operation from the folder machine even though this prior art only contemplated receiving shingled stream(s) to reform them into a single shingled stream. This prior art teaches a method and apparatus to generate a single shingled stream from a nested shingled stream or two shingled stream, by creating a shingle single-file stream and then re-shingle the stream into a single shingled stream.

With regards to shingling at a folder machine by other means than a fly, U.S. Pat. No. 5,102,111 dated Apr. 7, 1992 assigned to Heidelberg Druckmaschenen AG entitled "Folder for a print machine" introduces a shingling device that relies on a gripper device to de-accelerate books where the gripper device must be mechanically timed to the press speed. This art may be superior to the conventional fly systems. However, both are mechanical timed devices, a process negative. In passing, as will be pointed out later more fully, the operations of cutting and folding of a folder machine are very precise during which each copy is firmly controlled. This precision lends itself to a highly symmetrical flow of copies, which is ideal for any timing sensitive subsequent process such as shingling. Thus U.S. Pat. No. 5,102,111 is very similar to U.S. Pat. No. 3,994,221 dated Nov. 30, 1976 issued to F. John Littleton, Effingham, Ill. and U.S. Pat. No. 4,040,617 dated Aug. 9, 1977 issued to Colin Walkington of Bristol, England in that all three rely a direct timing relationship to cutting cylinder of a folder machine. In a true sense, their mechanical timing proclivity is quite similar to that of the fly shingling apparatus and its operational negativeness in terms of reliability, dependability and limited production speed.

In the printing industry, a rotary printing "web" press typically has one or more folder machines at its discharge. A typical folder machine is one that receives ribbons of paper and performs the operations of cutting the ribbons into equal lengths, folding each length and delivering each folded length as a printed product in a shingled stream on an exiting conveyor. A printed product of one or more folded sheets is commonly called a book (or signature). When a "book" is folded only once, such as one section of a newspaper, it is referred to as a half-fold book. When a half-fold book is folded a second time, perpendicular to the first fold line, it is referred to as a quarter-fold book. Both half-fold and quarter-fold books may be created "in-line"into a wide number of products by folder machines. Once the "in-line" books are half-folded and/or quarter-folded, they are typically issued to a fly shingling apparatus of a folder machine in a single-file stream and exits in a very specific format called a shingled stream. A typical shingled stream of books is one where the next book is resting squarely on top of the prior book, and so on, on a conveyor as they exit the folder machine. However, the leading edge of the next book is behind the leading edge of the prior book by two to four inches and so on. A good comparative imagery of a shingled stream of book is the conventional arrangement of roofing shingles on a sloped domestic roof where the roofing shingles at the lowest elevation is comparable to the forward end of a shingled stream of books issue from a folder machine. Almost unanimously, the leading edge of the books in a shingled stream is their backbone. The backbone of a book is the line, and the edge, of the last fold put into it at the folder machine. As an example, if you are reading the front page of a conventional North American newspaper, a half-fold product, without opening its first page, the "last" (and only) folded edge is at your left-hand side. This folded edge is the half-fold backbone of that book. The tail of that book is the opposite side on your right side; a collection of page ends. The width of this half-fold book is its height or the length of the backbone line. Its length is the distance from the backbone line to the tail end. The cut-off length of the press and folder machine is twice the length of a half-fold copy. Typically, a web printing press and folder have a single cut-off length since the requirement of precision in cutting and folding dictates fixed machinery components.

Increasingly in the web printing industry two, or more, books are issued as a set of books from the cutting and folding operations of folder machine in a nested array and delivered in a shingled stream as if each set was a single book. As a visual aid to this interesting idea of nesting books, assume that the above mentioned newspaper had three sections, A, B and C. Each section can be said to be an individual book where book C is inserted into book B and book B is inserted in book A. As you hold this whole newspaper closed on a table in front of you as if you were reading the front page of book A, move book B and C away from you as one piece so that their backbone is still against the backbone of book A and so that the books B and C protrude approximately by two inches beyond the top edge of book A. Now, move book C without moving books A and B so that it protrudes by two inches above book B. This arrangement of books is one set of three nested books. This nested book arrangement is achieved from a web press by misaligning the ribbons of book C relative to the ribbons of book B and those of book B relative to book A before the folder machine. In this way, books A, B and C are folded simultaneously as if they were one book. Similar to the above description of a shingled stream, a single shingled stream of nested books is one where one set of nested books rests squarely on another set except that the common backbone of each set is two to four inches apart. This distance between the backbone edge of books in a shingle stream is called the shingle pitch (P). The purpose of nesting books is to optimize the full width of a printing press. Web presses are purchased in assorted web widths ranging from 12 to 70 inches. A popular width is 36 inches. Often, a given printing run cannot use the full width of a press. Because of this fact, it used to be very common to see web presses running using paper widths that are 50% or 60% of the width of a web press. Rather than using less than the full web width of a press, nesting is a practical and powerful means to increase production rates by up to 100% by delivering a book of each set of two nested books to its own separate flow line. Nested book may be two or more similar or dissimilar books. Typically, a print run of 300,000 copies operates at 30,000 copies per hour (ch) can be run nested, the press-time to complete it will be 5 hours rather than 10 hours at $300–400 per hour machine-time, the savings is $1,500–2,000 for this single press run or as much as $1,000,000 per year.

A half-fold book produced "in-line" on a web press is the result of multi-colour printing on both sides from the unravelling of a wide large roll of paper. This continuous sheet of paper is threaded through multiple printing press units (one press unit per process ink colour—i.e. black, yellow, blue and red) from a roll of paper. This length of paper is commonly called the primary web. After this primary web is fully printed, that is, all ink colors are applied, it is usually slit at desired locations parallel to the sides of the primary web to result in secondary webs. A secondary web is commonly called a ribbon. Each ribbon is then threaded so that one is placed precisely on top of others prior to a folder machine. These ribbons may be aligned or misaligned in numerous different ways to achieve many desired results at the folder machine. A simple half-fold conventional folder machine can generate a single-file stream of books, nested or not and then shingle the books. More complex folder designs are capable to generate a single-file stream of half-fold books and then quarter-fold the books in line. If such a complex dual folder is not available to a printer and his customer wants a quarter-folded book, the half-fold books from a simple folder machine must be re-processed off-line. This is very costly.

Other special folder machines are capable to generate two (or more) half-fold or quarter-fold shingled streams nested or not. For the present purposes, it is not relevant to explain how the manipulation and arrangement of ribbons may result in the simultaneous production of multiple books exiting in a single or multiple shingled streams. However, it is important to understand that each stream of books must exit the cutting and folding operations of any folder machine in a consistent and orderly sequential manner; a precise symmetry of exiting books imposed by the folder machine design. Also, it is important to know that, almost without exception, folder machine designs are fundamentally similar. A single width simple folder machine delivers one stream of books in a single-file stream after cutting and half-folding with a very high level of book symmetry. That is to say that the books flow forward in a straight line with a constant precise cutting and half-folding operation can be done on a double-width cylindrical folder rollers to process two sets of ribbons, side by side, to result in two streams of books simultaneously, side by side.

Alternatively, the folder machine may be double-circumference cylinder folder roller to generate two half-fold books at once from each set of ribbons to result in two streams of books simultaneously, one above the other. When a folder machine issues two streams, each stream possesses a precise symmetry of books (well aligned with one another and spaced apart identically). More importantly, the books of each stream are in perfect symmetry with one another (one book of each set cut and folded at the folder machine is spatially fixed in relationship to the other). This precision in book symmetry must exist. If it did not exist, book jams would occur. Given the high speeds of present-day web printing, a single book jam could be very onerous in terms of lost production and serious folder machine damage.

To generate this precision of the cutting and folding operations in a folder machine, the ribbons (and half-fold books issued from them) are continuously and securely pinned at all times. This fact lends itself to excellent symmetry of books. However, once books of a stream enter the standard fly shingling section of a folder machine, this symmetry of books is made less perfect by the requirement to process each book, one at a time, without full pinning control since this art of shingling involves putting each book into free flight and then stopping each one abruptly. While this fly shingling art is subject to a wealth of refining arts, none of these overcome its fundamental operational negatives of free projectile flight, severe mechanical timing proclivities and the risk of book skewing due to full stoppage of each book.

Let us take a closer look at a web press set-up with a simple folder machine that only half-folds. Also, let us assume that each book produced is made of four nine inches wide ribbons using twenty-four linear inches of each ribbon per book to be folded once at the centerline of its 24 inch width. Each set of sheets cut from these ribbons is a half-folded into a book. This book consists of 8 half-sheets printed on both sides. This book is called a 16-page tab. If this 16 page tab print run was abruptly stopped without breaking any of the four ribbons, the four ribbons immediately prior to the folding and cutting operations of the folder machine would be observed to be in perfect page symmetry. The first purpose of the folder machine is to cut this set of four ribbons sequentially at pre-set points into twenty-four inch lengths. This 24-inch length is called the "cut-off" of the folder machine and the "cut-off" of the press it serves. Typically, each folder machine and web press has a common cut-off length.

The second purpose of this folder machine is to half-fold each set of the four ribbons simultaneous in unison with the above mentioned cutting operation.

The third purpose of the folder machine is to reform the single-file of half-folded books that results from the two prior operations into a single shingled stream. To accomplish the first two purposes of the folder machine, one popular prior art is to accurately and consistently feed this set of four ribbons to a folding cylindrical roller in which there is mounted a precisely timed knife to cut the ribbons. Also, there is lateral cavity in the cylindrical roller to create the center-line of the book being cut. Simultaneously, the book being cut is tucked into this lateral cavity to break the tensile strength of the ribbons and to grip that book securely at its new half-fold line (its backbone). This new book travels securely pinned around the circumference of the cylindrical roller and exits between a nipping roller set assembly that permanently creases the four sheets at its half-fold backbone and move it safely away before the next book arrives. Unless the forward speed of the half-fold books are increased or decreased after they are released from the jaw of the lateral cavity in the cylindrical roller, the stream of half-fold books issued from nipping roller assembly will be in a single-file stream of books spaced, one after the next, by the width of one book. In all cases, this stream of books has perfect internal book symmetry. If it did not, the process of cutting and folding would be too fragile to operate at modern high production speeds of 8 to 25 half-fold books per second. Accordingly, all designs of folder machines are precisely mechanical timed operation of cutting, tucking and half-folding devices achieved while maintaining each book under full-pinned control.

In other more complex folder machines, the symmetry of exiting books may be different than explained above. However, the symmetry of exiting books must also be flawless prior to the shingling operation. Other typically symmetries are (1) two single file streams, one immediately over the other, where one stream of books is precisely and steadily out of phase with the other and (2) two single-file streams, side by side, where the books of both streams are in perfect phase with one another. This term "book phasing" is about the position of each book of the pair of books simultaneously cut and folded as they exit the half-fold section of the folder machine.

Unfortunately, the conventional practice of the printing industry to immediately convert each single-file stream of books of a folder machine into a shingled stream using a fly shingling apparatus of the folder machine tends to reduce the degree of perfect book symmetry that existed.

It would be useful to analyse the design of a fly shingling apparatus of a conventional folder machine to better understand its limitations relative to the flyless shingler section of the machine assembly of the present invention.

A conventional fly shingling assembly is a standard final operation of a folder machine. It is a device that receives the orderly and fully controlled single-file stream of half-fold or quarter-fold books with their last backbone forward after the prior cutting and folding operations of the folder machine to reform the books into a shingled stream. While there is a host of prior art to improve control over the free flight of each book entering a fly shingling apparatus, it is impossible to totally eliminate this negative feature of turning a single-file stream of a fully pinned book into a free flight projectile, one by one. First, the books typically travel horizontally before the fly shingling apparatus in a single-file stream. Then, each book is re-directed downwards into a V-segment of the rotating flywheel of the fly shingling apparatus. First, one V-shaped segment catches and stops one book once it is released (unpinned) and the next V-segment catches the next book and so on. Second, each V-segment rotates to move the prior book of the single-file stream out of harm's way before the next book arrives at the next V-segment. The fundamental reality of these three operations (catching, stopping and rotating each book) is that the pinning control over each book in a single-file stream cannot continue as each enters into its V-segment. Further, the production speed at which these three fundamental operations must be performed is as much as 70,000 ch (copies per hour) or about 20 books per second. The commonly accepted maximum speed limit for a conventional single stream fly shingling system is approximately 35,000 ch. Because of this, most presses are slowed down to avoid product jams at the flywheel of the associated fly shingling apparatus.

Essentially, all designs of these flywheels are similar. In design, they are like a series of adjacent bicycle wheels mounted one beside the other on a common shaft that is turning clockwise to receive the flow of incoming single-file books at about 2 o'clock from above. These bicycle wheels have no rims/tires and the spokes are severely bent backwards as if they were flexibly bent by the centrifugal force of this clockwise rotating flywheel assembly. A V-segment is formed by two adjacent spokes of each adjacent bicycle wheel that are in perfect alignment with each other. This creates a distorted V-segment pocket to receive and catch one book as the fly assembly rotates clockwise. Once one book is caught in one V-segment of these flywheel fingers, this circular assembly is precisely rotated so that the next V-segment is positioned to receive and catch the next book and so on. Sequentially, the forward surface speed of each book is stopped in its V-segment of the flywheel at the apex of each V-segment and then it is deposited on an exiting conveyor stationed just below the flywheel to move the books tangentially and shingled. The surface speed of the exiting conveyor is set so that the backbone of the next book is laid down about 2 to 4 inches (Shingle Pitch) behind the backbone of the prior book and so on. Of course, this surface speed of the exiting conveyor determines the actual shingle pitch.

Conventionally, two sets of finishing equipment and two sets of staff are required to trim/stack two streams of books. Two sets of finishing equipment can cost between $200,000 to $600,000 per stream. The typical staff costs for one or two person per book stream can cost between $350,000 and $700,000 US per year in the United States.

However, when the nested sets of books are two different products, it is necessary to have two separate streams and two sets of finishing equipment/staff. The preferred embodiment of the present invention permits that a nested stream by reformed into one or two streams as requires from print-run to print-run without duplicity of desertion equipment and without wasting press-time to convert from one or two streams et-up to the other set-up. Equally important, double-width and double circumference folder machines were conceived to make use of two fly shingling units simultaneously to result in higher production yields than possible from a single fly at 35,000 ch.

SUMMARY OF THE INVENTION

It is an object of the present invention to provide an apparatus to separate non-shingled symmetrical streams of copies into a symmetrical single-file stream, nested or not.

It is a further object of the present invention to change two side by side separate non-shingled symmetrical streams into a symmetrical single-file stream.

It is a further object of the present invention to provide a method and apparatus to change a single nested stream of copies, shingled or not, into a single-file stream of non-nested copies.

It is a still further object of the present invention to provide a flyless stream shingling method and apparatus.

It is an object of the present invention to reform two single-file streams of books, one immediately above the other, issued from a double-circumference folding cylinder of a folder machine with its two half-fold fly shingling assemblies disabled. Typically, the two books created at the same instant are issued in two streams, one above the other, with one of each pair being one width of a book ahead of the other. These two streams are said to be out of phase by the width of a book. Each of these two streams is moving horizontally at the same surface speed. Each enters a pitch-enhancer section of the machine assembly of the present invention running a higher and preferably, equal surface speeds. The first purpose of these pitch-enhancer sections are to increase (or decrease) the gap (pitch) between the books of each stream without destroying the symmetry between the books of both streams. Preferably, this surface speed increase creates more distance between the sequential books of each stream so that, when the streams are later merged in the lower merger section, process control may be maintained with greater ease. The top stream enters the upper merger section as the lower stream enters the lower merger section. In the preferred embodiment of the machine assembly of the present invention, the lower merger is a horizontal conveyor on which the bottom stream of books (primary) travel straight forward while being held securely by an upper pinning belt assembly to maintain the positional relationship of the books. The upper merger is of a similar construction. Both pitch enhancer sections have an adjustable upper pinning assembly so that the books entering may be nipped sooner or later by approximately 4 inches or as much as required. This allows for phasing adjustments between the two streams. As an example, if the surface speed of both pitch enhancer sections are 300% higher than the surface speed of both incoming streams and the upper pinning assembly of its upper stream nips one inch later than the lower stream, the upper stream will advance two inches relative to the lower stream while maintaining the book symmetries of, and between each stream. The upper merger directs the upper stream of books (secondary) downward to be deposited on, or behind, the books of the lower stream (primary) at a point of convergence at the exit of the lower merger section.

At the point of convergence, the upper (secondary) books may ride piggyback on the lower (primary) book in a continuous book stream with gaps between each set of books where the secondary books are back of the primary book by, say, one-half of the width of a book (called the shingle pitch) with a gap between each set of one-half of a book's width. This is one of many desirable book symmetries at the point of convergence.

Another is where the books of the two streams are in a single-file without any gap at the point of convergence and the books of the upper (secondary) stream are deposited out of phase with the books of the primary stream by one-half the width of a book. This equal surface speed maintains the gap symmetry of each stream of books while the distance adjustment of either stream, or both, is to establish the desired effective gap or shingle pitch at the point of convergence. This permits the establishment of a desired book symmetry of books at the point of convergence at the exit of the lower merger section without the need to know which two books of each stream are an original pair produced at cutting and folding cylinder. Since perfect book symmetry exists at the two entry points to the machine assembly of the present invention as a pre-requisite, the sought book symmetry at the point of convergence between the two streams may be set at a press crawl speed. Once set, the merged book symmetry at the point of convergence will remain steady at all press speeds. Indeed, it is one preferred method of the present invention to take their two side by side streams, shingled or not, and re-locate them into an above and below arrangement of the first and third purposes before entering the machine assembly of the present invention.

It is important to note that it is not necessary to reform the books into a single-file stream at the point of convergence on the lower merger section. In fact, the only important feature of the books at the point of convergence is that the books possess some regular observable book symmetry such that each book, sequentially and alternatively, arrives at the entry of the next section, the book separator, in exactly the same time interval.

As an example, the non-shingled books of the first and second purposes of the present invention may be merged to sets of books at the point convergence each consisting of an upper book resting on a lower book with the backbone of the upper book behind the backbone of the lower book by one-half the width of each book such that each set of books is separated from the next set by a gap of one-half the width of a book. This is one of the preferred book symmetry at the point of convergence. Similarly, the incoming shingled books may be merged at the point of convergence so that the shingle pitch of both streams are increased to, say, half the width of a book at the exit of their respective pitch enhancer sections and the upper stream books are deposited piggyback on the lower books so that the two streams are out of phase by one quarter of the width of a book in a continuously symmetry at the point of convergence on the lower merger section. In this last example, the "effective" shingle pitch of the books at the point of convergence is 25% of the width of a book. The term "effective" shingle pitch is used here because, strictly speaking, this piggyback stream of books of this example is not a genuine shingled stream. However, this piggyback stream of books is a desirable book symmetry at the point of convergence that will bring its books to the next section, the book separator, one by one, alternating between primary and secondary books in the same time intervals. Also, books can be delivered to the book separator section in sets of two books, a secondary book precisely on top of a primary book.

As an example of one aspect of this invention (two incoming shingled streams into one), the primary and secondary books can both have a shingle pitch of half the width of a book and the secondary books can be out of phase with primary by half a book at the point of convergence. This is a useful symmetry since it reduces surface speeds involved by 50% or doubles the books merging throughput. Here, the output single stream will be a single-file of two books, one on top of the other separate by a constant gap or where the shingled streams are in sets of two books.

Another preferred book symmetry at the point of convergence is to open each stream so that its books are backbone to tail but where the secondary books are out of phase with the primary books by half of the width of a book. Another book symmetry at the point of convergence is to deposit a secondary book squarely upon a primary book with a constant gap between set. In this book symmetry, the set of books will exit the machine assembly of the present invention in pairs. Or, the secondary book be placed with a small shingle pitch on the primary book (say one quarter of an inch) so that each set will not be put into a single-file stream by the book separator section so that the final stream may be a shingled stream with a small pitch followed by a larger pitch and so on.

The method of the present invention covers all possible book symmetries at the point of convergence, including but not limited to, symmetries created by same or different surface speed ratios between the two merger or the two pitch enhancer sections, or excluding the pitch enhancer sections altogether. In passing, different surface speeds could be used between the secondary and printing streams if the book symmetry of each stream entering the machine assembly is internally perfect but non-symmetrical one stream to the other. As an example, if the upper stream has four books per linear foot and the lower stream has six books per linear foot, the surface speed of the lower pitch enhancer section can be increased so that the shingle pitch of both streams is equivalent at the exit of the pitch enhancer sections. Further, take note that the distance of travel in each merger section does not have to be identical since books will arrive at the point of convergence in a perfect symmetry (unchanged from their entry symmetry) which may be changed to the desirable merged book symmetry by adjusting the travel distance in the pitch enhancer sections.

With regard to "side by side" streams, (although it is preferred to re-arrange them into an above and below array), the method of reforming the two streams into one uses precisely the same principles as that used to reform nested streams other than that nested books are reformed using a single pitch enhancer section followed by a lower merger section. In the pitch enhancer section, for a single stream of nested books, the shingle pitch of the nested stream of books is increased without disturbing the backbone to backbone relationship of each pair. In the lower merger section, a higher forward surface speed is applied to the outer books of each pair than the inner books while both continuing moving in the forward direction. In this way, the backbone to backbone relationship of the two books of each pair of books is opened up at the point of convergence. The preferred book symmetry at the point of convergence is where the distance between the backbone of each set and shingle pitch between two consecutive sets is half of the width of a book. With this symmetry, the backbone of inner book of prior pair will be precisely on top of the backbone of the outer book of the next pair at the point of entry to the book separation section. This book symmetry is preferred if the subsequent book processing equipment can handle a "two by two" stream, single-filed or shingled. If so, this book symmetry utilizes half the surface speeds to generate a certain production rate and/or twice that production rate.

The above discussion of creating book symmetries in the first five purposes of the present invention is merely to provide a basic understanding of the broad principles that underpin the present invention. In the above descriptions, pairs of books issuing from a folder machine are described as if the sole intention of the present invention is to merge these streams by creating a desired book symmetry at the point of convergence of each two books of a pair, one in relation to the other. In fact, the present invention covers the merging of non-pairs of books as long as the book symmetry of the two streams are themselves regular at the point of convergence of the machine assembly or as long as an acceptable book symmetry may be established at this point using the adjustable upper pinning option and/or difference surface speeds of each pitch enhancer section.

In actual practice, a web press starts up very slowly (crawl) to set web tensions, align its ribbons, check its printing quality, colour tones and so one. During these typical crawl periods of 15–30 minutes, the symmetry of the books at the point of convergence will be exactly similar to that which will exist at full (red line) press speeds. Given that the book symmetries at the entrance to the machine assembly of the present invention is known, as if the machine assembly's design and dimensions, the adjustments at the pitch enhancer of travel distance and all relative speeds can be pre-calculated and set. Therefore, the start up periods are excellent opportunities to make final minor adjustments that might be required to establish a specific desired book symmetry at the point of convergence at full press speeds. Clearly, the books of each pair produced at the folder machine are no longer identifiable at the point of convergence since one of each pair will rarely travel the same distance as the other before or after entering the machine assembly of the present invention.

Therefore, the preferred method of the present invention to achieve the desired book symmetry at the point of convergence is to monitor the actual book symmetry at the point of convergence during the crawl period to permit adjustments to the machine assembly by varying the travel distance of each stream and/or changing their shingle pitch changing the surface speed at either or both pitch enhancer sections. Usually, both stream entering the machine assembly of the present invention has an internal constant book symmetry and in relation to one another. However, the important issue is whether or not the books, sequentially and alternatively from each stream, arrive at the book separator section in an equal and repeated interval of time. As an example, if the lower stream of shingled books has 300 books per 100 linear feet (a 4 inch shingle pitch) and the upper has 400 books per 100 feet (a 3 inch shingle pitch) prior to their pitch enhancer section, this is a perfect internal symmetry but a lack of symmetry between the two streams at entry. In this case, the time interval of the entry of each book to the machine assembly will be constantly changing if surface speeds are equal for both streams, this lack of symmetry between both streams will also exist at the point of convergence. This is unacceptable. Fortunately, this may be corrected at pitch enhancer sections of the machine assembly of the present invention while running the upper and lower merger sections at the same surface speed.

In this case, if the upper pitch enhancer is given a surface speed of 33⅓% faster than the lower, both streams will have exactly the same shingle pitch at the exit of the pitch enhancer section of 300 books per 100 linear feet. Then, both merger sections may be set to run at exactly the same surface speed higher or equal to the upper pitch enhancer. If the mergers ran at different surface speeds, the pitch or gap of the primary and secondary streams at the point of convergence would be different and this would defeat the fundamental premise of this invention to create perfect book symmetry at this point of convergence. As an example, the backbone of the piggyback books at the point of convergence would not have a steady effective shingle pitch with the consequence that the merged piggyback books would not enter the next section of the machine assembly, the book separator, in sequential and alternating order, one after the other, separated by an equal time interval.

The above discussions covering the merging of two streams, single file or shingled, into one single stream is unique new art that is easily distinguishable from the existing prior art. In U.S. Pat. No. 4,696,464 dated Sep. 29, 1987 entitled "Method of, and an Apparatus for, uniting at least two streams of shingled . . . folded paper products" inventor Hagen Gämmerler teaches that to merge streams, it is fundamentally necessary to start with two shingled streams and then it is of primary importance to use "clock generators" to accelerate the books of each to result in a single file stream. Regretfully, this prior art focuses almost entirely upon a method of controlling the distance (the shingle pitch) between the backbone edge books of each shingled stream to its machine assembly assuming that this is the essence of stream merging. Apart from accounting for different book widths by an adjustable roller, this method attempts to fire one book from each stream sequentially to arrive at a point of convergence in a symmetrical synchronized manner. In theory, this timing sensitivity is similar to that of the fly shingling apparatus and therefore subject to similar limitations.

The present invention accepts the resultant symmetry of books generated by sequential books arriving at the point of convergence from two streams at the same surface speed and adjusts the phasing of the two streams, one to the other, by adjusting the distance of travel of each stream in their prior pitch enhancer section in which both streams have equal surface speeds. It may be seen that the present invention also contemplates different surface speeds of the two pitch enhancer sections but, only (and strictly) to correct differing book symmetries at the entry point to these two sections if this correction may in fact result in perfect symmetry by virtue of surface speed adjustments. In addition to the above explanation, the present invention does not limit itself to merging shingled streams only. The present invention also handles single-file streams.

The present invention disclosures a method of shingling in its flyless shingling section that provides aerodynamic control innovative and methods over book flight without resorting to mechanically timing devices synchronized to the cutting and folding operations of the folder machine. In the prior art, U.S. Pat. No. 5,913,656 issued to Collins on Jun. 22, 1999 entitled "Method and apparatus for merging signature streams", the art teaches that the books of two shingled streams may be each collected in a primary stack where the stack may be moved as one mass by gravity to a common collector bin (final stack) that may then be reformed into a single shingled stream. This prior art utilizes the known art of stacking signatures (copies) as the final web press operation that is then transported to a bindery department where the books are then re-processed to perform additional operations such as trimming.

The present invention teaches that by varying the travel distances of either stream at equal surface speeds in its pitch enhancer section, the sheets or books at the point of convergence can be adjusted to many different symmetries rather than the "two by two" symmetry of this prior art. Further, when two streams lack symmetry with each other, such as a different shingle pitch for shingled books or different gaps for single-file streams, this insufficiency may be corrected by utilizing different surface speeds for each stream in its pitch enhancer system. Finally, the present invention teaches that the management of stream symmetries requires stepped controlled surface speed changes to maintain physical control over each sheet or book during the whole process of merging streams.

To introduce the book separator section, let us assume that the shingled books of one stream are piggybacked on the other shingled stream at the point of convergence. Once these books are in piggyback array, at the point of convergence, the method of the present invention and the purpose of book separator section is to securely nip the backbone of each book fed to it from the point of convergence. The higher surface speed of this section is set as required to open these sequential books so that they will exit the book separator section in a single-file stream of books with a desired fix gap width between each book at the exit of the book separator section. Obviously, it is important that the effective shingle pitch of the piggyback stream is constant so that alternate books arrive at the book separator section at equal intervals of time. This book separator section is a series of belts on a supporting lower driven conveyor to which the books are pinned by an upper pinning assembly belt/pulley assembly.

In the preferred embodiment of the machine assembly of the present invention, both the lower supporting conveyor and upper pinning assembly are driven at the same forward surface speed whereas all other upper pinning assemblies of the present invention may be passive (not driven). Naturally, the present invention includes the option of utilizing driven upper pinning assemblies at other locations and only excludes them where it is rational and feasible. The idea of driving both lower and upper is to avoid tearing of the books caused by sudden accelerations at transition points such as the entry to the pitch enhancer mergers and book separator sections. However, the present invention has found that tearing may be effectively eliminated without driving the upper pinning assembly. Tests have proven that tearing at the initial points of nipping each book is principally due to imperfections in sudden pulling forces at these points than the surface speeds.

To overcome the dynamics of changing toward thrusts imposed on the backbone edge of each book, the machine assembly of the present invention includes the design of pinning assemblies to prevent instantaneous changes in nipping pressures at these points of thrust. Towards this end, the upper pinning assemblies are permitted to move vertically above their nipping plane using high quality pneumatic cylinders of known art to provide a constant controllable nipping pressure. Preferably, the pinning pressure of the upper pinning assembly of the book separator section is applied by one or more pneumatic cylinders operating as shock absorbers above the single-file stream of books under it so this upper pinning assembly is aligned as squarely as possible in the x and y axes in real time. This design was found to be so effective that the upper pinning assembly of the book separator section may be passive riding freely on the lower fixed pinning assembly. However, the present invention covers more or less control over each pinning assembly since this nipping pressure control on each book is solely to deal with slippage and/or ripping of the books at the points of entry nipping on the backbone edge of each book. If the increase in surface speed at the book separator section is relatively high as compared to the merger section(s), the forward thrust at each nip point of each book results in a tensile stress in the book at the entry point to the book separator section. This may damage that book and disrupt the whole printing process.

Accordingly, the preferred machine assembly of the present invention includes the use of known conveyor belt material that grips the books securely without excessively stressing each book at these nip points. This preferred belt material has a relatively low coefficient of friction so that an instantaneous increase in nip pressure caused by movements in the shock absorbers will not unduly increase the pulling stress levels on the two nipping points on each book. The books will tend to slip rather than tear at certain higher and uneven nip pressures. Since the movement and nipping pressures are caused by the thickness of each book and all books of a given print run are fairly constant in thickness, the slippage characteristics or pattern is also fairly constant as long as the upper pinning assembly design allows for specific dampened movement.

A book can be about one-eighth of an inch thick, 8 inches in width and in a single-file stream moving at 30 books a second in the book separator section. When the upper pinning assembly is forced to rise to pass the backbone leading edge and descend caused by the gap width and book thickness, chatter results. Chatter instantaneously alters the nipping pressures in a complex and dynamic way. Since it is desirable to control this chatter, movement is designed into the upper pinning assembly so that its four nipping points move up and down in pairs, front to back, and also side to side. Also, this movement permits perfect seating between the upper and lower assemblies so that the instantaneous gripping of each book is supplied evenly over the width of the impinging one-inch wide belts rather than the edges of each belt. Finally, the nipping pressure caused by the weight of the upper pinning assembly can be neutralized by a pneumatic cylinder that accurately supports this weight so that the force at each nipping point will be of the order of or 3 psia.

The final and important feature of this upper pinning assembly is that its end pulleys are not mated with the end pulleys of the lower pinning assembly. In fact, the upper pinning assembly is shorter from pulley to pulley than the lower pinning assembly so that the upper rides on the lower belts of the lower conveyor without making contact between the pulleys of each pinning assembly. The preferred lower elastic belts depress slightly under the net weight of the upper pinning assembly and thrustle point of contact of the upper and lower assemblies move vertically as the books pass without chatter. This eliminates all chatter, vibrations and nipping pressure variance, which eliminates all book tearing. In fact, the test results conducted using this floating point of contact was so successful without driving the upper pinning assembly that the costly and difficult driving of the upper pinning assembly may be abandoned at all possible press speeds. Accordingly, the present invention includes the use of an upper pinning assembly consisting of a free turning not driven single pulley riding on each one inch belt of the lower pinning assembly counter weighted manually to lighten its natural weight force on the books which rotates freely to coincide with the surface speed of the lower pinning assembly. The present invention prefers that each book is nipped at two points at its backbone edge to prevent book skewing and to reduce pull force and tension stress at the points of contact. However, the present invention includes a single point such as one provided by say a two or three inch single belts or multiple belts.

Finally, the design of the book separator section of the present invention can include a device of known art such as a laser beam sensor that monitors the sequential gap widths and book widths at its exit. The data of the actual gap width measurements and the effective book widths are supplied to a Programmable Logic Computer (PLC) as data from which its software can control the surface speeds of the sections of the machine assembly proportional to the press speed while establishing/adjusting the ratio of speeds of the sections of the machine assembly of the present invention, one to the other, to achieve the book symmetry sought at each stage. As an example, if the press speed increases, the gap width will decrease at the laser sensor in the book separation section. This decrease gives rise to relative speed changes of the sections of the machine assembly. Alternatively, the measurements of the gap may be used as information for manual adjustments. Further, press speed following may be achieved by the known art of encoders that monitor the incoming surface speed of each stream in conjunction with full vector motor/drives. Indeed, the present invention covers machine assemblies of the present invention without automated gap width control since this may not be necessary in many applications.

Once the single-file stream of books leave the book separator section, each book individually, and sequentially, enters the final flyless shingler section of the machine assembly of the present invention in a regular and consistent book symmetry (books in a single-file with a specific gap width between them). It is noted that this perfect single-fold book symmetry exists in all conventional folder machines prior to being eliminated by their conventional fly shingling apparatus. However, this painstakingly created single-file book symmetry at folder machines has never been utilized to merge two such streams into one single-file a shingled stream. The most relevant prior art to the present invention to merge two streams into one is U.S. Pat. No. 5,833,226 entitled "In-Line Deserter and Integrator Apparatus and Method" issued on Nov. 10, 1998 to the same assignee as the present invention. However, even this teaching did not contemplate reforming two single-file streams of books into one single-file stream of into one shingled stream. Rather, it focussed on reforming two shingled streams or one nested stream into a single-file stream of books for the sole purpose of further reforming the books into a single shingled stream.

A paradigm of the industry rests squarely on the blind assumption that stream shingling was an absolute requirement and that shingling, due to its severe timing proclivity, must be accomplished as the final operation of a folder machine. The negative consequence of this longstanding practice is that the perfect single-file stream symmetry of the cutting and folding operation of folder machines is immediately eliminated in favor of the perceived necessity to immediately create a shingled stream of books. Once this premature shingling is complete, the important task of joining two shingled streams into one stream necessitates that both streams must be de-shingling to result in a single-file stream that existed with more precision prior to shingling in conventional folder machines.

The embodiment of the present invention is to reform one nested stream of books, shingled or not, into a single-file stream of books. For this, the machine assembly required is one sequential set of one of each of the following sections in a single path: pitch enhancer, lower merger and book separator. In terms of these sections, the pitch enhancer and the book separator sections of the present invention are disclosed in the prior art of U.S. Pat. No. 5,833,226 issued Nov. 10, 1998 to the same assignee as the present invention, the teachings of which are hereby incorporated by reference. Also, the differential section of this prior art is replaced by the lower merger section of the machine assembly of the present invention. (As will be discussed below, the reintegration section of this prior art is also replaced by the flyless shingler section of the present invention to radically and innovatively improve the shingling operation.)

Assume the inner book of each nested pair of books protrude from right side of each set as the books, with their backbone forward, move to the left from the right of the viewer in a shingled stream. Therefore, the inner books are closest to the viewer. As the nest stream of books move to the right, the shingled inner books are pinned along their protruding side by a primary pinning assembly moving forward at the same surface speed as the pitch enhancer section, the entry section of this nested stream to the machine assembly of the present invention. However, the outer book stream in the present invention is pinned by a secondary articulated pinning assembly along their protruding side (furthest from the viewer) and moving approximately parallel to the direction of travel of the inner books at a higher surface speed than the primary stream. This articulated pinning assembly (secondary) moves the outer books forward of the inner books in the lower merger section by running the outer books forward and faster than the inner books. This causes the backbone of an outer book to assume a new more forward position relative to the backbone of its inner book of each set in a symmetrical manner that depends on the relative speed of these two pinning belt assemblies, primary and secondary.

The object of this book symmetry change is to provide a stream of books to the next section of the machine assembly, the book separator section, one by one, in equal intervals of time. In this way, the book separator, running at a higher surface speed than the lower merger section, will receive books sequentially and alternating between both streams in equal intervals of time and reform the books into a single-file stream.

However, the preferred embodiment of the machine assembly of the present invention consists of two paths, side by side, to handle two separate streams of single books entering their own, side by side, pitch enhancer section. In the lower merger section, the furthest of the two streams from the viewer, called the secondary stream, is tangentially merged to the closest stream of books, the primary stream, by causing the books of the secondary stream to tangentially move towards the primary stream. This is achieved by rotating the articulated pinning assembly of the lower merger section and positioning the table of the articulated pinning assembly of the lower merger section appropriately.

Alternatively, this articulated pinning assembly and table of the lower merger section may be positioned to accept nested books from one pitch enhancer section so that the outer books, the secondary stream, are pointed slightly tangentially (1 or 2 degrees) towards the inner books and directed forward and faster into the primary path of the machine assembly of the present invention.

Also, the present invention envisions that a nested pair of books may be two different products that require de-nesting into two single streams, shingled or single-filed. Alternatively, the machine assembly of the present invention will separate nested books, which are like products to one stream, shingled or single-filed. This dual functionality of the machine assembly of the present invention is important since web press production schedules often require that print runs alternate between one and two steam deliveries without losing press time to set up for a change of the number of exiting streams. Since the table of the lower merger section must move perpendicular to the incoming stream(s) to accommodate different book lengths, side by side, (7 to 17 inches), it is obvious that the travel path of the table must be wide.

As an example, a pair of nested books with a length of 7 inches would have an overall, side to side, dimension of 9 to 10 inches. However, a pair of 17 inch books would be 19 or 20 inches. Preferably, the width of each stream path is about 22.5 inches such that the two paths together are about 45 inches in width. The table width of the lower merger section is approximately 24 inches wide mounted on two perpendicular shafts on which the table can be moved laterally to accommodate different book sizes. To work functionally with this lower merger section design a different position across its 45 inch machine width, the present invention includes rectangular plastic pieces sized to fit (i.e., 12"H× 36"L×1"W). These vertical plastic boards clip on the traverse shafts of the lower merger table using undersized half-circle cut-outs on the lower 36 inch length so that the upper 36 inch edge is a flat one inch surface and parallel to the flow of books. In this way, several of these plastic boards form a supporting adjustable surface on which books may travel. The present invention is unique in its: (1) ability to merge nested books without a stagger; (2) book gap monitoring control in its book separator section; (3) includes new capacity to merge two single-file (non-shingled) streams into four modular overall designs; and (4) its final section, the flyless shingler section.

In greater detail, with regard to merging nested books without a stagger, this refers to the protrusion between the inner and outer book of each set. In the lower merger section of the machine assembly of the present invention, the articulated secondary pinning assembly may be tangentially aligned to direct the outer books toward the inner books so that the sides of the inner and outer books are squarely aligned at the entry point to the book separator section. At this point, the protrusion between the books of each pair is no longer required. Here, the inner book of each pair is precisely inside the outer book but their backbone edges are separated. This separation is all the book separation section requires apart from the necessity to receive books at each interval of time. In this way, the stagger of the books of the prior art that required a separate additional operation of jogging the books in the single stream is eliminated.

Second, the gap width control system in the book separator section of the machine assembly of the present invention uses a laser beam detector system, or other known similar art. This detector is a means to monitor the quality and regularity of the book symmetry of a fast moving single-file stream of books (as many as 120,000 books per hour) in real time. The gap width data is used in conjunction with a PLC and software interfaced by an encoder of known prior art for each motor/drive of each section of the preferred machine assembly. This system controls the surface speeds of books in each section of the machine assembly of the present invention. Since the relative surface speeds of the sections of the machine assembly are set a predetermined values to result in a selected book symmetry at each section based on the known book symmetry at their entry point(s), the gap width monitoring and control may be used to make automatic relative speed adjustments during each press run.

This gap sensing system is also a means to provide automated press speed tracking and following. As the press speed increases, the established gap width between the single-file books will decrease unless the relative speeds of each section of the machine assembly of the present invention are increased proportionately. As a result, the relative speeds of the machine assembly of the present invention may be ramped without direct monitoring of the actual press speed or the surface speed of the entering streams to the machine assembly of the present invention. Once the desired gap width is achieved, or this value is being approached, the proportionally increasing relative speeds of the sections of the present machine assembly may be halted. It is obvious that once this preset gap width is established, the software may provide for adjustments to the relative speeds of the sections of the machine assembly to deal with any speed ratio anomaly that may arise.

As an example, if the actual gap width monitored is increasing above a desired preset gap width value, the book separator surface speed may be trimmed in relation to the lower merger surface speed. Again, if the monitored book symmetry is an apparent wider book length (one book partially on top of the other extending its apparent length and this symmetry is not desired) followed by a regular gap, this undesirable book symmetry may be automatically changed to a symmetrical single-file stream by lengthening the distance of travel in upper pitch enhancer section. If it is desired to create a single-file stream at the point of convergence, the surface speed of both the upper/lower merger sections may be increased equally if the gap is not sufficiently large. If it is desired to have piggyback array of books at the point of convergence at the exit of the lower merger, without gaps, the gap may be eliminated by trimming the surface speeds of both pitch enhancer/merger sections equally.

Third, the prior art did not contemplate reforming two (non shingled) single-file streams into a single-file stream, directly or indirectly. Furthermore, the prior art assumed that the merging for two separate shingle streams was an identical process to the merging of a nested stream where the merging principle is solely about phasing of the two books of each set. With the prior art, the merging of two different shingle streams was seen as a process of phasing the books at the point of convergence created by placing the books of the secondary stream piggyback on the primary stream, such that the two are out of phase with one another. This phasing means that the backbone of the leading secondary book is placed behind the book of the primary stream and on top of all primary books. In the prior art, this phasing was created by running the, side by side, primary and secondary streams at different surface speeds in its differential speed section. Unfortunately, when two incoming shingled streams of books arrive at this forward differential speed section each with perfect internal book symmetry, and with each other, to create this desired piggyback symmetry, a higher forward surface speed is imparted to primary stream relative to the slower secondary stream.

This is necessary to create the effective phasing (or symmetry) of the piggyback books at the point of convergence will not be constant. This means that the shingle pitch of the primary stream will be greater than the shingle pitch of the secondary stream at the point of convergence. This means that the two streams are not symmetrical to the point of convergence. This further means that the effective shingle pitch of the piggyback stream will not be a constant (non symmetrical). Therefore, each alternating book between the primary and secondary streams will not arrive at the book separator section in equal time intervals. As a result, the gap width between the sequential single-file stream of books after this book separation section will not be identical. As an example, assume that the shingle pitch of both, side by side, shingled streams is two inches at the entry to the differential speed section and the book of the primary stream enters first. If the forward surface speed of a first book of the primary stream is increased to tangentially result in a piggyback effective shingle pitch of two inches at the point of convergence with the first book of the secondary stream, the next primary book will be closer than two inches back of the next book. The reason for this phenomenon is that the shingle pitch of the secondary stream is caused to be less than the shingle pitch of the primary stream at the point of convergence due to different forward surface speeds. As a result, the effective shingle pitch at this critical point of convergence will be constantly changing and the piggyback stream is said to be non-symmetrical. Accordingly, the prior art will become less efficient as the press speed increases to higher levels when integrating two shingled streams.

The machine assembly of the present invention necessitates that the forward surface speeds of both, side by side, streams are exactly identical and the book desired phasing (so-called in the prior art or book symmetry of the present art) is obtained by varying the relative length of travel of the two streams in a controlled manner in the two pitch enhancer sections. In fact, the machine assembly of the present invention envisions that two incoming streams can have a different shingle pitch or gap as long as each has an internally constant shingle pitch or single-file stream gap. While it is preferable to correct this situation prior to the machine assembly of the present invention, the two pitch enhancers could be run at different surface speeds so that the shingle pitch or gap of both streams are reformed to be identical at the exit of these pitch enhancer sections in connection with other adjustments that may be required such as the relative surface speeds of the two merger sections and/or the travel length in each pitch enhancer section. With regard to the reformation of a nested stream, this adjustable distance of travel at the pitch enhancer section is not possible or required since each set of books must necessarily start at the same starting point, same instant and travel the same forward distance to the entry point of next lower merger section. Therefore, the book symmetry at the point of convergence for a nested stream is a direct function of the relative speeds of each book in every set of books.

To merge two streams, one above the other, the distance of travel of the primary and secondary streams in the lower merger section is preferably dissimilar since it is easy for the modular design to bring the secondary (upper) stream down to the plane of the (lower) primary stream. All issued of travel distance are eliminated by this machine assembly of the present invention in its pitch enhancer section. Assuming that both streams have the same shingle pitch at entry (or single-file books have the same gap), the method of the present invention is to monitor the phasing at the point of convergence on the lower merger and to adjust the point of entry of both or either streams to the pitch enhancer section to establish the desired book symmetry at the point of convergence. The length adjustment of the pitch enhancer causes the books of the longer stream to move sooner at the higher surface speed of the pitch enhancer than the other stream moving at the slower in-feed surface speed of the press.

The present invention also provides for a method to reform a symmetrical single-file stream of books into a single shingled stream using a last section of the machine assembly, its flyless shingler apparatus. This section is a very important part of the machine assembly design since shingled streams are still the overwhelming preferred book stream orientation for trimming and stacking. Indeed, this preference for shingled stream is likely to remain strong for many decades. However, there are web press applications where this flyless shingler section will not be required and a single-file stream will suffice. Alternatively, this flyless shingler section may be utilized as a stand-alone machine assembly to replace the standard fly shingling system on any folder machine brand, old or new, for half-fold or quarter-fold shingling.

For purposes of summarizing and explaining the principles of this flyless section, the following discussion will describe it as a stand-alone flyless shingler replacing a fly shingler apparatus. Assume that a single-file stream of books is issued from the cutting and half-fold cylinder roller of a simple folder machine moving horizontally from the left to right. In this case, the single-file stream of books is fully pinned by an upper pinning assembly riding on the lower conveyor assembly. Both pinning assemblies are typically driven at the same surface speed. This is the equivalent to the single-file books at the exit book separator section of the machine assembly of the present invention in all the first five purposes discussed above. Now, assume that the upper pinning assembly is longer that the lower conveyor assembly and extends forward (on the right side) and tangentially below the plane of the lower conveyor, at say, a 20 degree angle from the horizontal. Further, assume that the belts of the upper pinning belts and the lower conveyors are both made of series of one inch wide belts, one directly on top of the other in pairs where the pairs extend across the face of the single-file books spaced by one inch between belt sets. Now, assume that stationary lengths of stripping fingers are positioned between the overhanging upper belts at a forward angle, at approximately 30 degrees from the horizontal, so that they intersect with, and extend beyond, the underside of the overhanging conveyor belts.

First, when viewed from the prospective of a leading backbone edge of a first book exiting from the pinning action of upper pinning assembly and lower conveyors, it is being forced to first travel downward on the underside of the belts of the overhanging upper pinning belt assembly as it moves to the right.

Second, the first book is forced to travel on the underside of the stripping fingers as it moves downwards beyond the intersection line of the overhanging belts and stripping fingers. Preferably, the backbone of this first book is touching the top of the prior book laying flat on an exiting horizontal conveyor of the flyless shingler section just before the tail end of this first book is released from the higher upper pinning assembly and lower conveyor assembly at the point where the overhanging portion of the upper pinning assembly begins. With the prior art of U.S. Pat. No. 5,833,226 dated Nov. 10, 1998 issued to the same assigned as the present invention, the backbone of the first book was pinned to the underside of the overhanging belts and it was assumed that the tail end pages would likewise be glued by Vector forces to the underside of the overhanging belts. Unfortunately, this full book pinning control does not always exist due to air turbulence and/or light paper stock. In the present art, the second more steep re-direction caused by the stripping fingers cause the tail end of the first book to be glued against the overhanging belts by the centrifugal force imposed on the tail end of each book in this dual downward transition. This fundamental improvement with respect to the prior art permits higher press speeds and permits higher speed runs for books of lighter paper stock.

Then, at the exit of the exiting lower horizontal conveyor running at a reduced forward speed, the backbone edge of this first book is nipped and thrusted forward using the tips of the stripping fingers as a fulcrum line acting on the tail end portion of this first book. The second fundamental aspect of a flyless shingler section of the machine assembly of the present invention is that the backbone of the second book transitioning downwards under the overhanging conveyor belts is above the tail end of first book during the early downward transition of the second book. Ideally, the backbone leading edge of the second book must not touch the tail end of the first book until the backbone of the second book is first laid upon the top surface of the first book on the exiting conveyor of the flyless shingler section. Since the books of the single-file stream from a folder machine or a book separator section are travelling at a relatively high speed, a processing negative, the book entry speed may be lowered to a degree that closes the gap space between the books of a single-file stream as long as the books in their descent to not violate the fundamental downward principle stated above. The forward surface speed of the exiting horizontal conveyor of the flyless shingler section is set in relation to the incoming surface speed of the single-file stream depending on whether it is desired to reform these books into a shingled stream, or not, and to generate the gap or shingle pitch desired. Indeed, the pitch of the shingled stream, the distance between the backbones (front edge) of the books on this exiting conveyor, may be changed as desired by increasing or decreasing the speed ratio between the exiting book from the book separator and the exiting conveyor of flyless shingler section.

For simplicity of discussion, the books received and issued have been described as moving horizontally in the book separator section but this could slope upwards or downwards. Indeed, the flyless shingler section and book separator section of the present invention envisions a wide assortment of directional changes for the books as long as: each book issued from the exiting nipping point of the book separator section is forced to move downwardly relative to the plane of books in the book separator section; the stripping fingers result in a greater downward trajectory of each book before it is free from the pinning control action of the book separator section; and the tips of the stripping fingers form a fulcrum line across the top of the first book so that its tail end is forced to move away from the underside of the stripping fingers to make additional space for the backbone edge of the second book. In passing, the second downward slope of a book under the stripping fingers is not absolutely necessary for all types of books such as extra rigid books or all production speeds.

In some applications involving heavier paper stock books and slow press speeds, the prior art of re-integrator of the U.S. Pat. No. 5,833,226 dated Nov. 10, 1998 issued to the same assignee of the present invention will suffice. This prior art teaches that the act of moving a first book downwards with its backbone forward puts its tail end at a lower elevation than the backbone of the second book and so on. This is an accurate teaching at the first instant that the first book becomes free of pinned at the exit of the book separator. However, at the next instant, after the first book is released by the book separator section, the first book of the prior art is de-acceleration in free fall (undesirable) while the second is still pinned to the book separator section and moving faster than the prior book. The first new teaching of flyless shingler section of the present invention that distinguishes it from the prior art is to disclose a method to significantly extend the pinning control over each book as it transitions downward. By the dual downward transition of each book the overhanging belts and stripping fingers, the spatial location of each book in real time during its brief descent period is strictly controlled. In this way, the flight of each book at each micro-instant in this process is precisely duplicated for all books.

This first aspect of the flyless shingler section of the machine assembly of the present invention is critical for process books of widely different aerodynamic characteristics such as book weight, rigidity and surface roughness (sheen) in order to achieve shingling of the books in a theoretically book jam free manner. At the instant that the tail of first book is completely free from the pinning control at the exit point of the book separator, the only control over this de-accelerating book is the pinning force imparted to it against the underside of the overhanging belts by the downward directional change and forward vectored velocity. The dual downward directional change pins the book in a fixed position on the underside of the overhanging belts and of the stripping fingers. This dual downwardly transition of prior book on the underside of the belts and of the stripping fingers assist to maintain the multiple pages of its tail end in contact with one another and pinned as a solid mass while it is sliding forward and de-accelerating. This pinning of the tail end of each book against the underside of the belts is due to the centrifugal force imposed on the tail by backbone under the stripping fingers. This first aspect of the present invention provides enhanced control over each book.

However, this flyless shingler section of the machine assembly of the present invention improves this prior art in another important second aspect. Again, once a first book is freed of the pinning control of the book separator, it begins to de-accelerate. It is no longer driven and the friction force and pinning against the underside of the belts and stripping fingers ensures orderly de-acceleration of each book. Meanwhile, the second book is controlled but not de-accelerating. The de-acceleration of a first book may cause the backbone of the second book to catch up to and/or pass the tail end of the first book. In fact, this must occur if the press speeds are increased sufficiently. If this occurs, a book jam in the machine assembly of the present invention is very likely. In turn, this may cause a costly emergency press stop.

To avoid book jams and permit higher production speeds, the second aspect of the flyless shingler section of the machine assembly of the present invention is to cause the tail end of the first descending book to be instantly forced away, and downwards, from the underside of the stripping fingers and the tail end of the first book so that the backbone edge of the second book may slide ahead into this space in a controlled fashion. This lifting away of the tail end of the prior book from the underside of the stripping fingers is created by nipping the leading backbone edge of the first book at the exit point on the exiting horizontal conveyor of the flyless shingling apparatus. This forward thrust on the first book using the tips of the stripping fingers as a fulcrum lines across the top surface of the first book causes the tail of the prior book to lift away from the underside of the stripping fingers. In another view of this second aspect, the portion of the first book from its nipped backbone at the exiting conveyor to the tips of the stripping fingers has a lesser slope than the tail end portion of the same book against the underside of the stripping fingers. The instantaneous forward thrust on that first book generated by the nipping action causes its tail end to instantaneously thrust away from the underside of the stripping fingers using the stripping fingers' tips as a fulcrum point (line). This action instantly and sequentially opens a space between the tail of the first book and the stripping fingers. While this open space is being created, the backbone of the second book is still fully pinned and moving at a constant and higher surface speed than the first book. As a result of this second aspect, shingling may be done at very much higher production speeds. When viewed together, the above two aspects extend the control exercised over each book as compared to the prior art. Since control is the essence of shingling, this increase in control and reduction in free flight periods is important.

In the preferred embodiment of the flyless shingler section of the present invention, the backbone of this first book touches down on the top of the prior book on the exit conveyor and slides forward surrendering its higher forward speed to surface friction. Further, this orderly de-acceleration of each book is aided and abetted by the combing fingers, which gently press the prior book against the book on the exiting conveyor just before the exit point. Similar to the stripping fingers, the combing fingers are adjustable in terms of height and slope above the books on the exiting conveyor. Apart from creating a second fulcrum point for each book, the combing fingers provides a light pressure point on the de-accelerating first book increasing its coefficient of friction on the exiting conveyor before it enters the exiting nipping assembly. At the instant before this nipping, the surface speed of the backbone of this first book should be approximately the same as the surface speed of the exiting conveyor to keep it fully extended. Also, the upper exiting nipping roller at the exiting conveyor is a controlled pressure point to ensure firm controlled gripping on each book.

Alternatively, this nipping point could be a separate assembly of upper and lower rollers immediately downstream of the exit point of the exiting conveyor of the flyless shingler section. This alternate nipping assembly could be separately driven. In the preferred embodiment of this invention, the forward surface speed of the book separator section and of the exiting conveyor of the flyless shingler section are each controlled in relation to one another and in relation to the incoming speed of the books at the point of convergence of the lower merger section. Also, the combing and stripping fingertips are adjustable in terms of their location and slope. Further, the slope of the exiting conveyor is adjustable relative to the slope of the book separator section so that the slope transition phases of the present invention and forward speeds may be adjusted to suit every pressroom application.

The preferred embodiment of the flyless shingler section of the machine assembly of the present invention includes an automated detect a book jam detection system using a light beam sensor system, or any other known art such ultra-sonic or capacitance mass sensing devices. Since all book travel an accurate controlled flight path under the overhanging conveyor, the sensor is strategically placed so that it will "see" a book surface where none ought to be. This point of "seeing" may be located just beyond the downward trajectory of the tail end of each book on exiting conveyor or just before, and above, the exiting nip rollers of the flyless shingler section.

Alternatively, the sensor may be placed so that it looks transversely across the book stream during their exiting flight where it will detect a book at regular intervals. If the light beam sees books for longer intervals, this means that there is a book jam in progress. If a book jam is detected in the preferred embodiment of the flyless shingler section of this invention, the forward edge of the exit conveyor of the flyless shingler section is mechanically caused to rapidly descent, like a trap door, to provide a means to clear away the books causing the book jam, all without stopping the press run. Once a blockage is cleared, the pneumatically operated trap door is rapidly moved to its normal position to resume normal production.

Alternatively or concurrently, another embodiment of the present invention is to clear a book jam by mechanically causing the pinning and nipping assemblies and stripping fingers and such to lift up using such known art as pneumatic cylinders. This would permit poorly aligned books to exit on the exiting conveyor at the flyless shingling in disarray to serve as an "on line" means for press operator to make final adjustments for good quality shingling without stopping the printing process.

Alternatively, the combing fingers could be a brush assembly and/or an air bar in applications where the second fulcrum line provided by more rigid combing fingers is not required. Further, the combing fingers could be replaced by a design of the exiting upper nipping roller assembly of the flyless shingler section such that it is a conveyor assembly using a large diameter roller above the exiting books before they reach the exit nipping point. In this alternative arrangement, the larger roller assembly rides on the exiting conveyor of the flyless shingler section. This conveyor belt could be a full width belt or a series of one each belts. However, the smaller roller assembly is positioned above the exiting conveyor plane of the flyless shingler section so that its lowest belt is moving in the direction of the book flow and sloped towards the exit nip point of the exit conveyor of the flyless shingler section. Effectively, this arrangement provides a wider angle at the exit nip point as if the exiting nipping roller assembly was very much larger. This downward sloping belt also prevents book bounce at the nipping exit point since the exiting books in this alternate arrangement do not benefit from the deceleration of the second book caused by sliding on the back of first books. However, its smaller roller assembly also serves as a replacement fulcrum line to replace the fulcrum line provided by the stripping fingers. The underside belts of this nipping assembly guides each book into the nipping point.

In an alternate arrangement of a book separator and flyless shingling section, the books were accelerated in the book separator section using two upper undriven pinning pulleys riding one two one inch belts that represented the surface of the lower pinning assembly. This eliminated all chatter, vibrations and variances in nip pressures. Since light book edges tend to fly randomly, each book passes between a stationary stainless steel upper and lower plate which sandwiching each book as it passes through the book separator section and which itself is sloping downward such that the extrapolation line of its plane intersects with the nip point at the exit of the flyless shingling section. However, each book is sandwiched and then released to stripping fingers set in the book plane. These stripping fingers continue to direct each book to the nip point except that the ends of stripping fingers divert the book more downwardly for about one quarter of an inch at their tips. This causes the backbone of the book to touch down on the exiting conveyor before the nip point and causes the book to roll as if it was subject to a sine wave. Once nipped, the stripping fingers act as a fulcrum point and force the tail end of that book downwards so that the backbone of the nest book can slide forward of that book's tail and above it. Experiments have shown this alternate arrangement to be highly effective at very high press speeds with rigid books and higher speeds with light paper stock. The exit nipping assembly acts as a fulcrum line and as a book guide, the stationary sandwich guides combined with modified stripping fingers extend the control time on each book. While the preferred and alternative of the flyless shingler section is as described as above, the present invention includes any and all mechanical means which transition books downwards, one after the other, without actually stopping them while ensuring that the tail end of the first book is at a lower elevation than the leading edge of a second book during their downwardly transition while exerting precise aerodynamic control over each book during its descent to result in the orderly creation of a shingled stream of books. Further, the book separator section could be the folder machine conveyor section after its precision cutting and folding. In such case, the flyless shingler section of the present invention could be driven by the folder machine using timing belt and pulleys. For universality of purposes and overall accuracy, the preferred embodiment of the machine assembly of the present invention is to drive each of its nine sections using Full Flux Vector motors/drives each with encoders and programmed such that one is the master and the others are the slaves.

Different combinations of the sections may be utilized. Some web printers may only require the flyless shingler section. Others may wish to do away with stream shingling altogether on a specific web press installation and wish to dedicate their machine assembly of the present invention to reform two streams into one with or without the flyless shingler section. Still others may want to omit the pitch-enhancing sections. The use of stepped relative surface speed control (pitch enhancer, dual speeds of the lower-merger, book separator and such) is preferred since it is practical and efficient to handle assorted book characteristic and press speeds. Still other printers may require that two shingled streams, one over the other, be merged into one shingled stream with or without, the flyless shingler sections. Still others may want a machine assembly that only permits them to reform a nested stream to a single shingled stream. Others may want to be able to desert nested books to two streams also. All these equipment functionality variations, and others that can benefit from reforming streams, shingled or not shingled, into one single-file stream are within the scope of the present invention. Also, the use of two steams to explain the stream integration method and apparatus of the present invention is not intended to limit the number of streams that are covered by the present invention. As an example, three books or more can be nested where two may be merged into one stream and the third book handled separately.

A preferred embodiment of the machine assembly of the present invention has a dual path to reform the above and below streams of its first and third purposes. This requires a third pitch enhancer section and upper merger section mounted above one of the two dual paths.

One may use the flyless shingler section on new folder machines to provide higher production speeds and/or to reform its single-file streams without shingling or with later shingling. This section may be retrofitted to used folder machines to replace their conventional fly apparatus for the purpose of increasing production speeds, providing a better single quality and reducing press downtime.

The lower merger section of the invention may be used as a stand-alone unit. Preferably, this lower-merger section has two full vector motors: one to run the secondary (articulated) pinning assembly and the other to run the primary pinning assembly. This lower-merger section is a stand-alone two-point deserter system. It is distinguishable art from U.S. Pat. No. 4,477,066 dated Oct. 16, 1984 issued to Rudolf Fisher et al and U.S. Pat. No. 5,5967,156 issued on Jan. 18, 1997 to the same assignee as the present invention, which are the premiere prior arts to reform a nested shingle stream into two separate shingled streams. First, the art of the present invention teaches that the secondary stream of a nested stream may be moved to the left or right of the primary stream as desired and alternately from print-run to print-run. This aspect of the present invention is very important since a two-point deserter system typically runs on many presses in a single printing plant where it is necessary to run different books simultaneously. Assume that nested books are entering in the stand-alone lower-merger section and moving away as viewed from its entry point. The secondary or articulated pinning assembly is typically positioned at 45 degrees to move the outer books of each set tangentially to the left of the primary (inner) books. Also, assume that both the primary and secondary streams are driven by one full vector motor with the secondary tangential stream running at 1.51 times the speed of the primary. In this way, the secondary stream positioned tangentially at 45 degrees from the primary will move forward slightly faster than the primary stream. This treatment of nested shingled books would result in two shingled streams both moving forwardly and away from the view and parallel to one another. By rotating the lower-merger section on its casters by 180 degrees, the secondary stream will be on the right of the primary stream pinning assembly. However, both pinning assemblies would be turning in the wrong direction and towards the viewer. To correct a direction problem, simply reverse the full vector motor/drive systems. Now, it will be noticed that the secondary pinning assembly must be rotated by 90 degrees so that it will move the outer book to the right of the viewer at 45 degrees and away from the viewer. The prior art of U.S. Pat. No. 4,477,066 issued to Rudolf Fischer et al on Oct. 16, 1984 fundamentally teaches that the forward speed of the tangential secondary speed must be equal to the primary stream. However, since the objective is to move the outer book of a nested set tangentially to the primary stream of inner books, the prior art of U.S. Pat. No. 5,597,156 issued on Jan. 18, 1997 to the same assignee as the present invention teaches that the outer book of each nested set of books must have a slightly higher forward speed than the primary stream. This latter prior art is essential to desert nested books at higher press speeds to ensure against interference and skewing of books as they are separated. This slightly higher forward speed for the outer books relative to the inner books allows the backbone edge of the inner books to move forward (slightly slower) so that its alignment will not be detrimentally affected by the outer book during the critical period in which the nesting still exist.

However, the present invention permits setting the relative speeds of both streams to avoid book skewing when it is desired to treat the inner books as the secondary tangential book. For this reason, the preferred embodiment of the lower-merger section has two primary pinning assemblies, one on either side of the secondary pinning assembly. In this way, left and right desertion may be accomplished without rotating the lower-merger section by 180 degrees. All that must be done is to rotate the secondary tangential pinning assembly appropriately. However, since this rotation by 180 degrees is very simple and easy, the relative speeds of the primary and secondary steams could be generated using one full vector drive/motor system as mentioned above. In this case, this single vector motor and 1 "in" to "1" and "1.51" out gearbox are fixed to the underside of the secondary stream table. The 1.51 gearbox speed drives the secondary tangentially pinning assembly and to "1" out shaft is coupled to a telescopic shaft that drives the primary pinning assembly.

In the above prior art of U.S. Pat. No. 5,597,156, issued to the same assignee as the present invention, the secondary stream, after separation, is reformed to travel parallel to the primary stream using a bump-turn fence 40. In principle, this stream diversion is sufficient since the backbone edge of the secondary book are always perpendicular to the forwardly direction of the exiting secondary stream. As a result, the side edges of the books of the secondary stream strike the fence pointed in the same forward direction as the secondary (and primary) stream flow. In practice, the fence is a stationary static plate positioned tight against the existing conveyor belts of exiting secondary stream. This tightness of the fence against the exiting secondary conveyor (and the necessity to not allow space between the two in which books can jam) gives rise to damages to the exit conveyor belts. However, this fence arrangement generates a very straight secondary stream, a pre-requisite for subsequent book trimming. The present art preserves this straightness in the exiting secondary stream but does this using a unique new method. First, remember that the backbone edge of the secondary books remain in the same orientation as the primary books, both with their backbone edge forward and moving forward in the direction that the nested books were originally travelling. In the present invention, the backbone of each book issued from the secondary tangential or articulated pinning assembly is nipped simultaneously by two passive rollers riding on an exiting conveyor to which the lower-merger stream is abutted. This two-roller passive assembly consists of a simple two-wheel assembly running on free turning bearings on an axial. Perpendicular to this axial is a shaft that itself is mounted securely to the frame of the lower-merger section so the distance between the nip points of the two-wheel assembly and the exit point of the tangential pinning assemblies to suit different widths of books. The idea here is to nip the backbone of the next book at the two-wheel point immediately after that book is freed from nipping by the tangential pinning assemblies. These two wheels nip the backbone of each secondary book simultaneously at two points and the conveyor speed carries the books forward in a very symmetrical manner. This innovative method of taking control of the secondary books sequentially eliminates the need for a fence or the exiting conveyor on which that fence rides of the prior art.

In a further aspect, this lower-merger section is supported by four electric motor driven hydraulic legs. When these legs are activated, they raise the worktable (and level it) to desired height. When these hydraulic legs of know prior art are protracted, the lower-merger assembly comes to rest on the floor on four fixed casters for easy manual transportation. In addition, there are two upside down U-beams mounted underneath the lower-merger unit so that the whole lower merger system may be lifted and transported by a lift-truck so that its deployment is rapid as a two-point deserter system.

Obviously, the use of hydraulic legs, casters and forklift U-beam rails are used in all modular combinations. Also, it is obvious that these rails are stationed so that they are approximately one inch above the floor when the casters of each modular system are contacting the floor. Speed is very important in any continuous processing such as printing. Therefore, the degree of difficulty of setting up of ancillary equipment is a very important consideration. Therefore, the ability to move position and adjust the height are important aspects of any deserter system as is the ability to supply and easily control its secondary and primary out put streams while providing a quality stream.

The same lower-merger section may be used as a bump-turn. If it is desired to receive a single stream to cause it to move perpendicular in a new book orientation (if the book is moving forward with their backbone edges leading and it is desired to move the books so that the side edge of each book is forward), the primary pinning assembly is disengaged and the single stream books travels tangentially with their backbone edge forward under the secondary tangential pinning assembly. Instead of pinning their backbone edges as above, as a two point deserter system, the same two-wheel pinning device pins the side edge of each book on an abutted conveyor moving away from the lower-merger section at 90 degrees from the original book direction prior to entering the tangential pinning assembly.

It is often necessary with web press streams to orient the backbone tail end edges of the books on the side of a stream so that the tail end side may be trimmed as the books passing in a straight line. The popular way to bump turn is to stop a primary stream with a fence placed beyond the primary stream's conveyor. Each book goes into free flight, hits a fence and falls unto a secondary conveyor moving at 90 degrees to the primary conveyor. This method has an inherent problem in that the books tend to skew on the secondary conveyor due gain to the free fall of books and to the abrupt stop to their forward velocity. This causes book bounce and necessitates that the diverted books must be jogged into a straight line so that the tail end of the books form a straight line for trimming purposes.

If it is desired to direct a single stream to a path parallel and adjacent to an original path, a stream divergence or re-direction, the lower-merger section will achieve this. For this purpose, the set-up of the lower-merger section is as described above, except that there is only a secondary stream. Convention stream diversion is achieved using a carousel type assembly similar in design to those used to deliver baggage in airports. Unfortunately, these carousels are costly and impact adversely on the quality of the shingled stream by skewing of the books.

The present invention provides for modular design. Modularity is beneficial for lower manufacturing costs and application versatility. First, the three pitch enhancers sections may be run at the same surface speed as the primary stream of the lower and upper-merger sections. Accordingly, a primary motor/drive can be fixed to the lower merger unit and made capable to drive these other units by sprocket/belts, toothed or not. Indeed, the secondary pinning assembly could also be driven by the same single full vector motor/drive using a telescopic shaft drive and gearbox to achieve its desired higher-relative surface speed for the secondary stream. A second motor/drive of the secondary pinning assembly may be mounted with the table of the lower-merger unit to provide a full range variable secondary tangential surface speed relative to the primary surface speed. The book-separator section and the flyless exiting section may be driven by their own full vector motor. In some cases, the book-separator section may not be required if the lower-merger section creates an acceptable symmetrical single-file stream. In other cases, the motor/drive of the book-separator section may drive the secondary pinning assembly of the lower-merger section at a fixed speed ration between the two using sprockets and timing belts preferably. In other cases, the exiting speed of the flyless shingler section can be driven by the motor/drive of the primary pinning assembly of the lower=merger section since the two will run at fixed rations (i.e. the primary surface speed of nesting books may be set at a fixed ration to the exit speed of the flyless shingle section as the primary speed may be fixed to the press speed). As an example, if the surface speed of the primary stream is three times the surface speed of the press to open the shingle of the nested stream three time (from 2" to 6") at the pitch-enhancer section and it is desired to exit the machine assembly with a 2" shingle, the exit surface speed of the flyless shingler section must be twice the press speed or ⅔ of the speed of the primary stream.

BRIEF DESCRIPTION OF THE DRAWINGS

Having thus generally described the invention, reference will now be made to the accompanying drawings illustrating an embodiment thereof, in which:

FIG. 1A is a perspective view of a half-folded book;

FIG. 1B is a perspective view of a quarter-folded book;

FIG. 1C is a perspective view of a single shingled stream of half-folded books;

FIG. 1D is a perspective view of a single set of nested books;

FIG. 5*a* is a perspective view of an enlarged portion thereof;

FIG. 6 is a side elevational view showing stream merging;

FIG. 7*a* is a top plan view of a 1 or 2 point stream desertion for nested books;

FIG. 7*b* is a side elevational view thereof;

FIG. 11 is a view of the lower merger section as a stand-alone 2 point deserter; and FIG. 11*a* is a perspective view of a portion thereof.

DESCRIPTION OF THE PREFERRED EMBODIMENT

Figure 2:
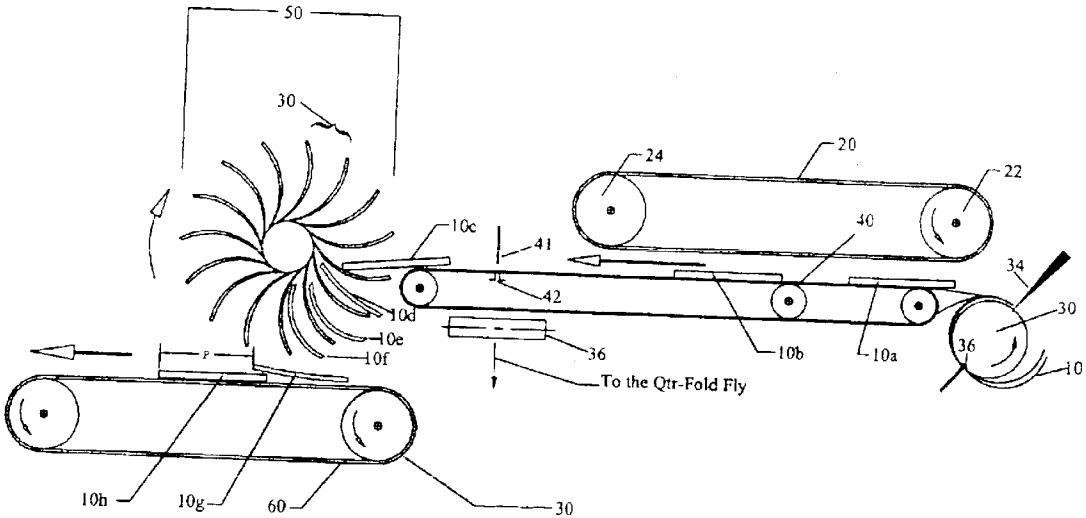
FIG. 2 is a side view of a standard folder machine.

For purposes of basic understanding of the book folding practices of the web printing industry, FIG. 1A exhibits a half-fold book 10 called an eight-page tabloid. This book 10 is made out of a sheet of two ribbons, 2 and 4, folded at their centerline 6. This centerline edge 6 is called the backbone of this half-fold book 10. When book 10 is closed, edges 8 a to d, form the tail of book 10. Typically, when book 10 is issued from a folder machine, its backbone 6 is forward and edges 8, a to d, are against one another and the book is moving as indicated by the arrow in FIG. 1A. FIG. 1B exhibits book 10 reformed into a typical quarter-fold book 12 with its quarter-fold backbone 14 perpendicular to backbone 6. FIG. 1C exhibits a typical single shingled stream of five half-fold books 10, a to e, moving forward with their half-fold backbone 6, a to e, forward in the direction of travel such that each backbone 6 is separated by a fixed distance called the shingle pit P. The typical shingle pitch of a single shingled stream from a folder machine is 2 to 4 inches±10%. Alternatively, books can be half-folded and nested as shown in FIG. 1D as a book set 24. In this case, a half-fold book 16 is nested inside half-fold book 18 with their respective backbone 20 and 22 against one another and book 16 protruding from book 18 as if book 16 was accidentally misaligned.

A shingled stream of nested books (not shown) is one where the book set 24 of FIG. 1D is placed on top of another set of books as shown in FIG. 1C. This popular practice of nesting books in a folder machine is a means to more fully use the maximum width of a web printing press in a print run. As an example, if a web production facility must run book 16 on a certain printing press and only 50% of the web press width is utilized, they may run another product, book 18, simultaneously and fold them in a nested array, book 16 in book 18. Or, they may run two nested books 16 simultaneously. These known systems separate a shingled nested half-fold stream into two single shingled streams for further inline processing such as trimming and stacking. Obviously, these prior inventions can double the productivity from a web press for a very small fraction of the cost for a second press (0.5 to 1.5%).

Increasingly, the marketplace for printed products is forcing commercial web printers to generate quarter-folded books as shown in FIG. 1B. These quarter-fold products are ideal for mail advertising. While half-fold and quarter-fold books may be accomplished off-line, it is cost efficient to creating both types of books inline. The conventional inline practice to generate a quarter-fold product, book 12 of FIG. 1B, is to create a half-fold book 10 of FIG. 1A and immediately fold it again in the same folder machine creating a new perpendicular backbone 14 inline as shown in FIG. 1B. Whether the folded product is half or quarter folded, each is then conventionally passed through a fly shingler apparatus (known also as a star or spider), one per book stream type.

Figure 3:
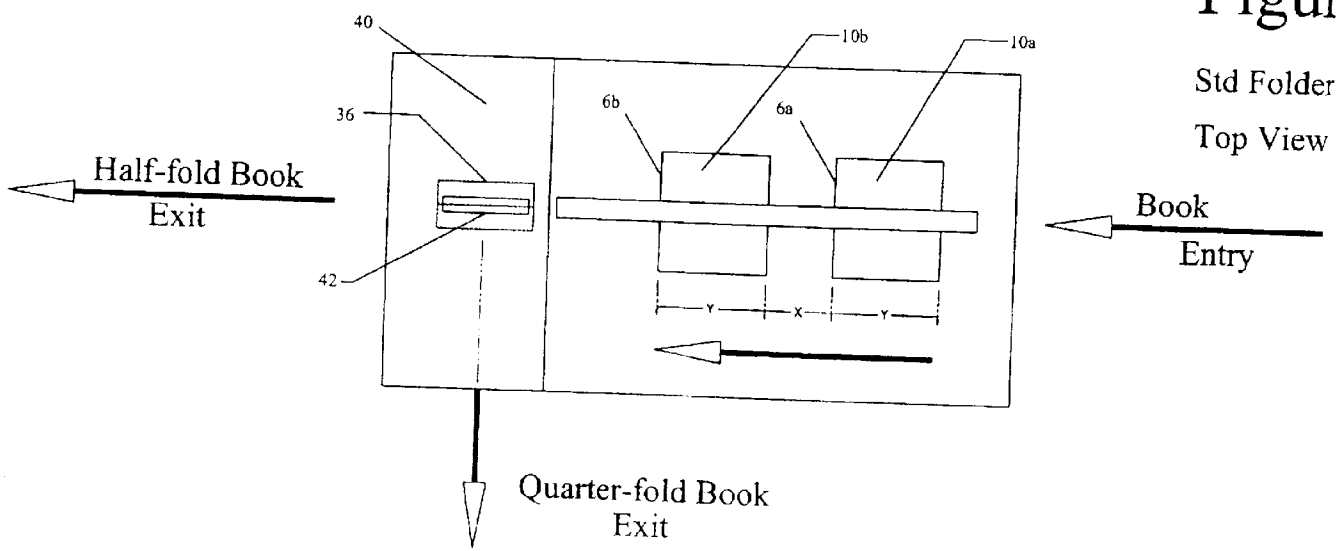
FIG. 3 is a top plan view thereof.

A schematic of a typical fly shingler apparatus of a simple folder machine for half-fold and quarter-fold is shown in the side view, FIG. 2 and the top view, FIG. 3. Two ribbons of paper, one on top of the other, are wrapped around the folding cylinder 30 to produce one copy of book 10. Cam operated cutting knives 34, shown in retracted position, cut the tail ends of a book 10. At the same time, a tucker blade 7 inserts that book 10 into a jaw 36 in the half-fold cylinder 30. This cam operated tucker blade 7 retracts as the cam operated jaw closes and firmly grips book 10 at its newly formed half-fold backbone 6. Book 10 is then deposited on conveyor 40. Book 10 is firmly pinned by conveyor 20 riding on conveyor 40 and delivered to half-fold fly 50.

The belting of pinning conveyor 20 and conveyor 40 are typically a series of one-inch wide parallel upper and lower conveyor sets of belts with approximately one inch space between each set. Also typically, there is a stationary platform under the belts of conveyor 40 to support the single file stream of books 10 issued from the half-fold cylinder 30. A book 10 enters the fly shingle apparatus 50, shown as book 10C in FIG. 2, into one of its V-segments 30. Fly 50 is typically located below the exit roller of conveyor 40 so that the books enter fly 50 from above at about one o'clock rather that at 3 o'clock as shown in FIG. 2. The fly 50 rotates clockwise to capture books, one by one, shown as book 10D, 10E and 10F.

These books, one per V-segment 30, are then delivered to the half-fold conveyor 60 and deposited as book 10G and 10H in a shingled stream with a shingle pitch P. If it is desired to quarter-fold the books, each book is typically stopped immediately before the entry point of fly 50 at aperture 42 where it is plunged downward by a cam operated tucker blade 41. This quarter-folded book 12 is then nipped by a roller set 36 to form the quarter-fold backbone 14 on book 12 (See FIG. 11B). The resulting single file stream of quarter-fold fly and exiting conveyor (not shown) precisely similar to fly 50 et al of FIG. 2 for half-fold books. Each fly and exiting conveyor set, such as fly 50 and exiting conveyor 60 as shown in FIG. 2, reforms a single file stream of books on conveyor 40 into a single shingled stream on conveyor 60. If the books are nested and half-folded, as shown in FIG. 1D, the resultant half-fold stream on conveyor is a shingled stream of nested books.

Nested half-fold books issued from the half-fold cylinder 30 of a typical single folder machine cannot be quarter-folded inline. If quarter-folding of nested books were done inline, this would permanently lock the books of each nested pair so that they cannot be separated. As shown in FIG. 3, a top view of FIG. 2, the stream of the single-file half-fold books, 10A and 10B, after being issued from the half-fold cylinder 30, are delivered in a single-file with perfect book symmetry. This term perfect book symmetry means that books 10A and 10B, and so on, are travelling in a straight line separated by a fixed distance "x" regardless of when this stream is observed. Depending on folder machine design, the distance "x" is not necessarily equal to the distance "y", the width of each book. But the distances "x" and "y" are constant in a single file stream with perfect book symmetry. This perfect book symmetry exists because book 10 is cut sequentially at the half-fold cylinder 30 and all these books must ravel the precise same path, distance and velocity to get to, say, the position shown for book 10A.

In theory, the circumference of the half-fold cylinder 30 is designed to be twice the width "y" of book 10. Indeed, the cutting of each book 10 can be done prior to the half-fold cylinder 30 as long as the leading (backbone) edge of each book is firmly secured on the cylinder 30 before book is cut from the advancing ribbons. Some half-fold cylinder 30 of folder machines have a double circumference so that two books 10 can be half-folded simultaneously one right behind another identical fly usually placed directly below fly 50 separated by approximately 3 or 4 feet. However, the two books cut simultaneously in double circumference folder machine designs are typically issued to two single file streams that are also perfectly symmetrical with one another although they are "out of phase" one with the other. This term, out of phase, means that the backbone of the two simultaneously cut pair of books are both spaced the same gap "x" between its books. However, one book of each pair is issued before the other usually by a distance equivalent to the width of the books. These two streams are said to be symmetrical with one another though "out of phase" with one another since the same relative positioning of books exist regardless of when these streams are observed. Other half-folding cylinders 30 of folding machines are double width to permit two sets of ribbons, side by side, on the folding cylinder simultaneously. In such cases, the two resultant shingled streams are usually issued "in phase" with one another. Whether the folder machine is a simple or a double circumference or a double width cylinder roller 30, the half-fold books issued in each stream must have a perfect symmetry, one book to the other. Further, when there are two streams of half-fold books issued from a folder machine, these streams are also in perfect symmetry to one another because of the precision cutting and controlled deliver of each book. In FIGS. 2 and 3, book pinning assembly 20, exhibited in a raised position, is shown to enforce the idea that books issued from all half-fold cylinder 30 must always be securely pinned. Otherwise, the integrity of cutting and half-folding would be wanton. An imprecise delivery of a single book from half-fold cylinder 30 could easily result in a very serious book jam and emergency stop to production. Even more critically, such a jam could cause major physical damage to the folder machine. In all of the above descriptions of folder machine designs, the book streams may be nested books as shown in FIG. 1D.

Figures 4A, 4B, 4C:
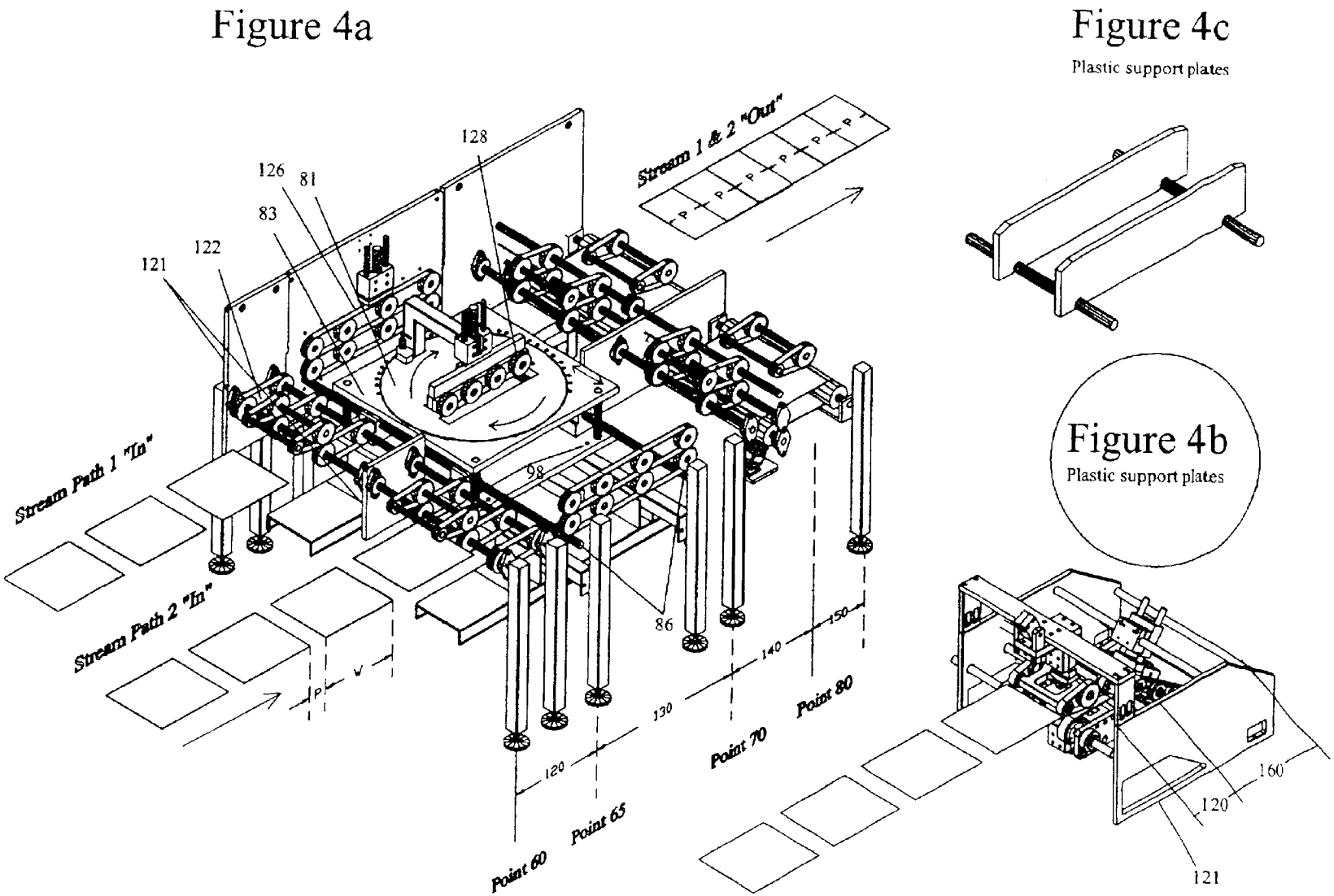
FIG. 4*a* is a perspective view of an apparatus according to one embodiment of the present invention, with portions thereof removed for purposes of clarity.
FIG. 4*b* is a perspective view of a portion of the upper pitch enhancer.
FIG. 4*c* is a view of the support plate.

A side view of preferred embodiment of the machine assembly of the present invention (with the front side plates removed for better viewing), shown in FIG. 4A, comprises two parallel and adjacent book stream paths 1 and 2 each entering at pitch enhancer section 120. In FIG. 4A, the viewer-side sidewalls 121 of the lower seven sections are not shown although the sidewalls of the two upper sections in FIG. 4B, the upper pitch enhancer 120 and upper merger sections 160 are shown. FIG. 4D shows a top view of the lower seven sections of steams 1 and 2 books with incoming pinning of each stream at 122/126 and 124/128 respectively. Both streams enter the lower merger section 130 where the books of stream 1 move forwardly under pinned control assembly 126 while the books of section 2 move in any forwardly direction under the upper pinning assembly 128 that may be oriented 360 degrees mounted on table 82. All of these upper pinning assemblies 122, 124, 126 and 127 may be passive (not driven) or driven. Further, the lower merger section 130 is shown in FIG. 4A to have a primary upper pinning assembly 127 exactly similar to pinning assembly 126. With pinning assembly 127, disengaged from lower pinning assembly 132, the books of stream 2 may be oriented towards the books of stream 1 using the tangential upper pinning assembly 128 for the purpose of depositing the books of stream 2 piggyback on the books of stream 1 such that the books of streams 1 and 2 are out of phase with one another at point 70 as shown in FIG. 4E.

Alternatively, nested books may be introduced into stream 2 (or 1) at an increased surface speed Sd through the pitch enhancer section 120 as shown in FIG. 4F. This increases the shingle pitch (P) from Pe to Po. Then the inner book of each set is moved forward by pinning assembly 127 at surface speed Sp and the outer books are moved forward by pinning assembly 128 at a surface speed Sp that is approximately 20% higher than Sp the surface speed of the inner books. The result is two streams exiting the lower merger section 130 more or less parallel to one another in a desired book symmetry at point 70, the point of convergence which is the entry point to the next section of the machine assembly of the present invention, the book separator section 140.

One book separator section 140 and one flyless shingler section 150, one set in each steam paths 1 and 2, are mounted side by side at the exit point of the lower merger section 130. Finally another pitch enhancer section 120 and an upper merger section 160 shown in FIG. 4B may be mounted directly above one of the stream paths 1 or 2. In summary, the preferred embodiment of the complete machine assembly of the present invention comprises nine modular assemblies: 3 identical pitch enhancer sections 120; one upper merger section 160; one lower merger section 130; two book separator sections 140; and two flyless shingler sections 150.

In the preferred embodiment of the present invention, each section has one own full vector motor/drive system wet with an encoder of known prior art except the lower merger section, which has two sets. Further, each section is modular in design so that assorted permutations and combinations of sections may be utilized to achieve all, or fewer, of the nine first purposes of the machine assembly of the present invention.

For clarity and brevity, we will discuss the preferred embodiment of the machine assembly of the present invention by dealing with the three types of book streams: two non nested symmetrical single file streams; two non nested symmetrical shingled streams; and one symmetrical shingled nested stream as in the $5^{th}$ purpose. It will be noted that the common objective is to reform these three types of streams into one single file stream. This exiting single file stream may be all that is required to create the desired savings in finishing equipment and production labor sought by the present invention.

Additionally, this solitary single file stream is an excellent book symmetry from which one solitary shingled stream may be generated when required. This solitary shingled stream is achieved by the modular flyless shingling apparatus of the sixth purpose of the present invention. This flyless shingling apparatus may also be used as a stand-alone equipment to replace the conventional means of shingling namely the fly (or star or spider) shingling apparatus used with folder machines. Further, the stand-alone lower merger section of the present invention may be utilized as a two point delivery system that receives a stream of nested books and delivers the inner books of each set to one stream and the outer books to a second stream.

In addition, the same lower merger section may be used as a stream bump turn and a stream diverter apparatus FIG. 4B is a top view schematic of two internally symmetrical half-folded single file streams, 1 and 2, of books 10 issued from a double width cylinder 30 of a folder machine, side by side, entering the machine assembly of the present invention at point 60. Purposely, the books of stream 1 are shown to be "out of phase" by a distance OP with the books of stream 2 as further shown in FIG. 4E. This "out of phase" distance (OP) means that the backbone edges of the books of stream 1 are not entering their pitch enhancer section 120 at the same instant as the book of stream 2 enters its section 120. However, the two streams are in perfect symmetry with one another since they are both in a straight line; have the same book width, W; gap between books, G, (since G1=G2); and both are travelling at the same surface speed Se. The reason for this "out of phase" depiction of these two streams, 1 and 2, is to take into account that it might be practically expedient to alter the phasing between streams 1 and 2 between the streams exiting the folder machine and the entry point 60 of machine assembly of the present invention by causing the streams to travel different distances to point 60. In this way, the following description will demonstrate that the present invention deals with such "out of phase" imperfections.

The only important requirement in the "installation specific" conveyor delivery systems to entry point 60 of the machine assembly of the present invention is that the books are sufficiently controlled so that their internal symmetry is maintained. Further, it is preferable that the surface speed Sp of both streams 1 and 2 at the entry point 60 are exactly the same. After all, this equality in surface speed exists when two streams exit from a double stream folder machine. However, if this original symmetry between both streams does not exist at point 60, this situation is not fatal to the present invention. As an example, if G1 and G2 are reasonably constant but G1 does not equal G2 (as was the case as both streams left the folder machine), this symmetry breaking may be corrected. If G2 is smaller than G1, this may be due to the fact that the surface speed of stream 2 is higher than stream 1. Therefore, the books of Stream 1 and 2 will not be symmetrical in real time at point 60. However, the books of stream 1 may travel faster in the pitch enhancer section 120 relative to section 120 of stream 2 such that book symmetry is established at point 65. Remember that the distance OP does not have to be eliminated at point 65 to have symmetry between streams 1 and 2. Between point 60 to point 65, the surface speed of the two pitch enhancer section 120 of the machine assembly of the present invention may also be increased by an equal amount to increase the gap between the books of each stream equally. The length of travel of each stream in their pitch enhancer section 120 may be adjusted by approximately four inches at the entry point 60 to compensate for the "out of phase" situation required at the point of convergence 70.

Figure 5:
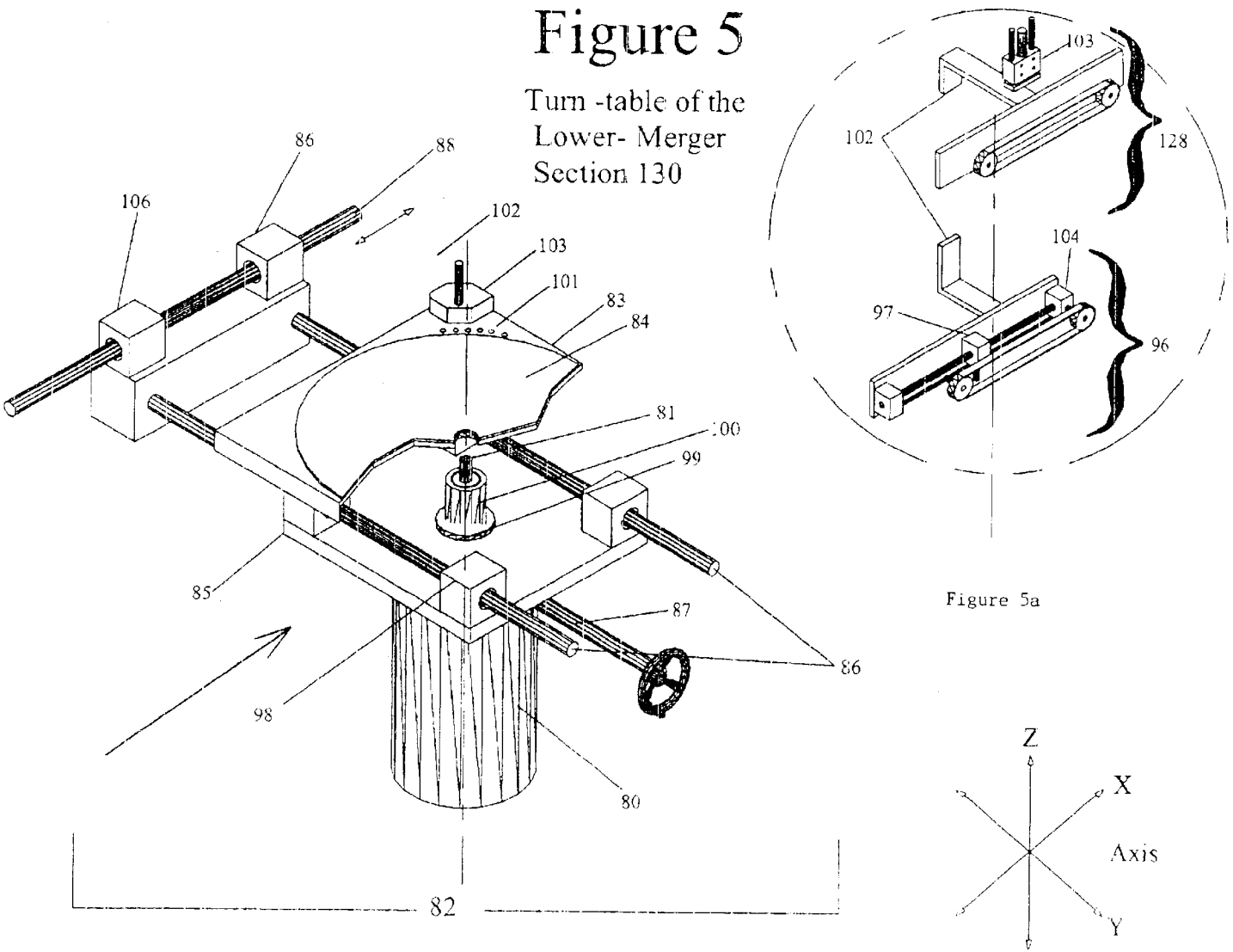
FIG. 5 is a perspective view of the turntable of a lower merger section.

This is accomplished by providing for horizontal movement of the upper pinning assembly of both sections 120 so that the higher surface speed conveyed to the books of both steams may be retarded or advanced as required. Also, since each pitch enhancer section 120 uses its own full vector motor/drive system, the surface speed of one can be increased more than the other to correct for a lack of symmetry between the streams at point 60. As en example, if stream 2 has a shingle pitch of three inches whereas stream 1 has a single pitch of two inches, streams 1 and 2 must be non symmetrical. These two streams can be made to be symmetrical at point 65 by increasing the surface speed of stream 1 relative to stream 2. Between points 65 and 70, (merging two side by side streams into one, be they single file or shingled respectively), the books of stream 2 are carried tangentially in the lower merger section 130 under pinning assembly 128 as shown in FIG. 4B towards the books of stream 1 at a surface speed Sa that issues the books of stream 2 sequentially and alternatively between the books of stream 1 at the point of convergence 70. Alternatively, the books of stream 2 may be deposited piggyback one, and out of phase with the books of stream 1. The upper pinning assemblies 126, 127 and 128 are known. However, the tangential pinning assembly of the machine assembly of the present invention introduces unique and innovative features as shown in an exploded view of table 82 (see FIG. 5) of the lower merger section 130 as shown in FIG. 5. This turntable 82, as shown in FIG. 5, is adjustable and positioned in the "x" and "y" axes of the book flow.

For the purpose of the tangential book travel of stream 2, a full vector motor 80 is mounted to a table 82 as shown in FIG. 5. This table 82 is mounted on four bearings 98 mounted on two parallel shafts 86. This permits the table 82 to be positioned along the "y" axis (perpendicular to original direction of stream 2 at the entry point 60). Table 82 may be positioned as required along the "y" axis to properly receive the books of stream 2 using a worm shaft assembly 87. Similarly, the assembly of table 82 and the two shafts 86 are mounted on two shafts 88 on both sides of the machine assembly of the present invention using bearings 106 that provide movement in the "x" axis (parallel to the direction of travel of streams 1 and 2 at entry point 60) using a worm gear similar to 87. However, this "x" axis movement of table 82 may not be necessary since the adjustments of the pitch enhancement described above may suffice to create the desired book symmetry at points 68 and 70. In this way, the tangential upper and lower pinning belt assemblies, 96 and 128, respectively, of table 82 controlling the books of stream 2, may be placed at the appropriate distance from stream 1 while ensuring efficient capture of the books of stream 2 by the tangential pinning assembly 128 at its entry point 60.

The shaft 81 of the full vector motor 80 passes through sleeve 100 mounted on a cylindrical turntable bearing 99 in the horizontal table 82. The shaft 81 of the full vector motor 80 drives the lower pinning assembly 96. The upper passive pinning assembly belt 128 rides on belt of the lower pinning assembly 96. The book travel surface of stream 2 on table 82 as shown in FIG. 5 is a square stainless steel skin 83 with a circular centerpiece 84. The circular piece 84 is fixed to the pinning assembly 96 so that the top belt surface 96 lies in the same surface plain as the circular piece 84 and the stationary skin 83. The outer square skin 83 is fixed to the table base 85 as is the full vector motor 80. However, the circular centerpiece 84 and, of course, the pinning assemblies 96 rotate relative to table 82 using turntable device 99 of known art such that sleeve 100 is free to rotate with 96 and 84 as one piece.

This centerpiece 84 et al is locked at a desired tangential angle using a simple retractable pin mounted on the structural support 102 that fits into pre-existing holes 101 in the outer square stainless steel skin 83 at the periphery of centerpiece 81 mounted in table 82. By simply lifting the retraceable pin 103, the circular center 81 may be rotated to the tangential angle desired. Further, as shown in FIG. 5, the pinning belt assembly 128 is fixed to the pinning assembly 96 by the common structural support 102. The belt of the upper pinning assembly 128 is movable in the "z" axis so that its belt may be pressured against the belt of the lower pinning assembly 96 using a high quality pneumatic cylinder 105. The shaft 81 of the full vector motor 80 is coupled to an appropriately sized right angle gearbox 97 and 104 to drive the lower pinning assembly 96.

With regard to the books of steam 1, the primary books, referring to FIG. 4D, each book is fully pinned on its side by upper pinning assembly 126. These upper and lower pinning assemblies set 126 and 133 are similar in design to the pinning assemblies 128 and 96 without the latter's 360 degree rotation. Both are similar in design to the pinning assemblies disclosed in U.S. Pat. No. 5,833,226. Preferably, these lower driven pinning assemblies consist of timing belt/toothed pulleys at each end where one is driven and the other is not. The pulleys in between are not pulling; rather, they are full wheels without teeth so that the top belt surface is horizontal.

Referring to FIG. 4D, the side of the books of stream 1 (closest to the books of stream 2 starting at point 65 at the entry to lower merger section 130 of the machine assembly), rests on a surface sloped slightly downward in the direction of the books of stream 2 and downward in the forward direction of book flow of streams 1 and 2 after point 65. In this way, the books of stream 1 while being fully pinned by the pinning assemblies 126 and 133 and moving forward will pass under the leading side of the outer square stainless steel skin 83 of table 82. In a same manner, the books of stream 1 are made to rise again to the book surface level of the tangential book stream 2 on the outer skins 83 and 84. This permits the books of stream 2 to be deposited on the books of stream 1 into a combined symmetry of a single file stream of books at the point of convergence 70 or into a piggyback array of stream 2 books nesting in stream 1 books.

One view of the symmetry of books at the point of convergence 70 is where the backbone of a book of stream 2 is deposited immediately behind the tail end of the prior book from stream 1. This symmetry requires that a constant space exists between the books of each stream that is equal or greater than the width of a book before the point of convergence 70. Alternatively, the secondary books of stream 2 may be deposited piggyback on the books of stream 1 where both streams are without gaps and where the books of stream 2 are out of phase with, and behind, the books of stream 1 by half a book. This preferred book symmetry at the point of convergence 70 ensures that books arrive at the next section, the book separator section 140, one by one separated by the same time interval.

In the preferred embodiment of the machine of the present invention, as shown in FIGS. 4A to D, the point of convergence 70 is the entry point for the next two abutting and, side by side, sections of this machine assembly, the book separator section 140. In these sections 140, the converged books are increased in surface speed while remaining under full pinned control. The books remain pinned until they exit this section 140 by two inches wide pinning belts, upper and lower, both driven. In fact, to drive both upper and lower pinning assemblies is costly and difficult. This is the case since it is imperative that the upper pinning assembly must also be retractable so that any book jams could be easily resolved.

Accordingly the present invention includes a means to operate the present invention without driving the upper pinning assemblies. This will be discussed more fully below. Approximately 10 inches after this nipping entry point to section 140, each book is controlled in surface speed to be a single file stream with a constant gap between consequtive books. At this point in section 140, each book passes under a laser beam sensing device of known art, or other equivalent prior art, where the gap distance between the single file exiting books (alternating from streams 1 and 2) are monitored and controlled with reference to a desired gap width. The ideal gap width depends on the maximum production surface speed of the books being processed. However, if the length of the gap is consistently greater than a preset desired value, the surface speed of the book separator section 140 may be incrementally lowered by command from a PLC.

Alternatively, if the gap is less than a preset value, the surface speed of section 140 may be increased. The present invention includes all possible perfect symmetry of books at the point of convergence 70 and the single file and piggyback book symmetries described above are merely preferred book symmetries. Further, the present invention includes all means to generate desired book symmetries so that the books may be reformed into a single file stream at book separator section 140. As an example, if the books of streams 1 and 2 at point 60 are shingled streams, it is preferable to open each shingle pitch to 50% of the book's width and deposit the books of stream 2 piggyback on the books of stream 1 such that the books of stream 2 are out of phase with the books of stream 1 by 25% of a book's width.

In this way, the book separator section 140 would operate at a higher relative surface speed to create the desired single file stream of books with a control gap width at the exit point of the book separator section 140. If it is essential to limit surface speeds as with books of very light paper stock, opening the books of both streams to a shingled pitch equal to 50% of the book's width in the pitch enhancer sections 120 and the lower merger section 130 may be desirable so that the backbones of the books of stream 2 could be out of phase and behind the books of stream 1 at the point of convergence 70.

As an example, if we are dealing with two incoming shingled stream or one nested shingle stream and the shingle pitch is increased to half a book at section 120, and the effective pitch at point 70 is guided to be half a book, books can enter the book separator section 140 two books at once, one squarely on top of the other. This can be made even better by retarding each pairing such that the top book comes out about one inch behind the lower book of each pair so that resultant exiting stream is symmetrical with two different and sequential shingle pitches. In this way, these piggyback books enter the book separator section 140 in pairs and exit in pairs. This pairing arrangement does not only provide for greater book rigidity in the flyless section 150 but it also allows for lower surface speeds by doubling the output. As an example, if the section 140 runs a 3 times faster than section 130, the books will exit with two effective shingle pitches; pairing at about 1.5 inches (if the pairing were 0.5 inch) and a gap of 50% of a book's width between each pair. This is an acceptable book symmetry for shingling and/or further processing. As described in the summary of the present invention, the desired effective shingle pitch or other book symmetries at the point of convergence 70 is easily established while a printing run is being set up and the press is running at a crawl speed.

However, it may be advisable in many applications of side by side single file streams from a folder machine, shingled or not, to bring them to the entry point of the machine assembly of the present invention so that one stream is directly above the other. In this way, these streams may be reformed into one single file steam according to the machine assembly at the second and fourth purposes of the present invention (handling above and below streams, shingled or not, issued from a double circumference folder machine). This sensible above and below arrangement avoids the complexities of merging for the side as described above. This avoidance of side merging is especially beneficial at higher press speeds. Accordingly, we will now discuss a preferred embodiment of the machine showing the reforming of two shingled steams, above and below, into one single shingled stream.

Typically, these above and below shingle streams are delivered from a double circumference half-fold cylinder where two books are simultaneously cut, half-folded and issued in two single file streams that are "out of phase" with one another by the width of one book. After, each of these streams pass through their respective fly shingling apparatus, this "out of phase" book symmetry is, more or less, maintained although the gap width between the books is typically reduced to a shingle pitch of 2 to 4 inches ±110%. Since it may not be practical in a given pressroom to place the machine assembly of the present invention immediately after the fly assemblies of a folder machine, it is best that the machine assembly establishes its own phasing relationship between these two shingled streams at the entrance point 60 to the machine assembly of the present invention, the pitch enhancer sections 120. It must be remembered that the books of each shingled streams 1 and 2 have the same shingle pitch and same surface speed as each enters its respective pitch enhancer section 120 at point 60. In this above and below stream arrangement, the tangential movement capability of table 82 of the lower merger section is not utilized. However, the upper merger section 160 and its abutting pitch enhancer section 120 is utilized (see FIG. 4B). This above and below stream configuration of the machine assembly of the present invention is best described by referring to side view schematic FIG. 6 which exhibits the ideal orientation of two pitch enhancers 120, lower merger 130 and upper merger 160 sections.

In FIG. 6, the path of stream 1 remains as shown in FIG. 4A. However, the path of stream 2 is altered such that it enters above stream 1 as shown in FIG. 6. Stream 2 enters its pitch enhancer section 120 and proceeds directly to the upper merger section 160 as shown. Each pitch enhancer 120 commences at point 60 and terminates at point 65. The upper merger 160 terminates at the lower merger section 130 just prior to the important point of convergence 70. The entry point 75 of the book separator section 140 of stream path 1 is just beyond point 70.

For applications involving nest books being delivered to one single file stream, point 75 is point 70. The preferred book symmetry of this machine assembly for this fourth purpose is to reform the books of stream 2 arriving at the convergence point 70 so that the books of each stream are tail to backbone and the books of stream 2 are out of phase by 50% in relationship to the books of stream 1. If the books of both streams travelled the same distance to the point of convergence 70 at a higher and equal surface speed than their equal, and lower, entry speed to the machine assembly at point 60, the "out of phase" book symmetry that existed at the entry point 60 would still exist at the point of convergence 70 on lower merger section 130. However, the books of streams 1 and 2 may be made to have the preferred book symmetry at the convergence point 70 by adjusting the length of travel distance of each stream of each stream between points 60 and 70 without regard for the book pairing issued by the folder machine.

Further, and independently, the relative surface speed of the pitch enhancer section 120 may be set to correct the shingle pitch of either or both streams that might exist prior to point 60. All that is required in the present invention is that there is perfect symmetry of books within each stream, and between both streams at point 65, the entry point to the two merger sections 130 and 160. When a press starts up, it runs at a crawl speed to establish all the press settings to print each book to acceptable standards. During this ample printing time period, the streams are fed through both pitch enhancer sections 120 at higher and equal surface speeds $S_1$ and $S_2$ ($S_1$=$S_2$) relative to the entry surface speed $S_e$ to result with the desired book symmetry at the point 65. Also, the upper merge section 160 and the lower merge section 130 are set at the same higher surface speed $S_m$ according to the theoretically required surface speed ratios to achieve the desired book symmetry at the point of convergence 70. If the shingle pitch (or gap) of streams 1 and 2 at a phasing point 65 is not equal or as required, this may often be corrected by adjusting both surface speeds ($S_1$ and $S_2$), or either ($S_1$ or $S_2$) of the pitch enhancer sections 120.

As an example, if the books of stream 1 have a shingle pitch at point 60 of four inches while the books of stream 2 have a single pitch of 3 inches, this lack of stream symmetry must be corrected. Accordingly, the surface speed of one or the other may be increased or decreased to result in an equal desired equal shingle pitch (or gap) at point 60. Then, if the books at the point of convergence 70 are not phased as desired, this may be corrected by adjusting the length of both or either pitch enhancer sections 120. Please note pulleys $P_1$ and $P_2$. Each rides on the belts of the lower pinning assemblies of both pitch enhancer sections 120 and that preferably there are two such belts and pulley systems. The set of pulleys $P_1$ ride freely on bearing in an axial and the axial is fixed to a shaft that permits that the pulleys $P_1$ may be re-positioned between points 60 and 65 by four or six inches. The size of all components and this length of motion of pulleys $P_1$ and $P_2$ are used only as an example without limiting the range or scope of the present invention. Then, if the book symmetry at the point of convergence 70 needs further adjustment, the equal surface speeds of merger sections may be increased or decreased to suit. Once the speed ratios are set and the nipping roller assembly of the pitch enhancer section 120 are adjusted at press crawl speeds, the book symmetry established at point 70 will continue to exist as the press speeds are increased but for the human error in precisely setting the precision of the book symmetry at point 70 at crawl speeds.

In practice, the relative surface speeds of the machine assembly of the present invention to the press surface speed may be fine tuned by the gap width monitoring and control at the exit of the book separator section 140 using known art such as laser beam sensors to "see" gaps and effective book widths. Since this gap width control may not be necessary in many applications, the present invention includes machine assemblies with or without this automated gap control feature.

In most applications, it is unnecessary to have different speeds between the pitch enhancer sections (or between two merger sections) since the only stream symmetry correction required by the machine assembly of the present invention is to adjust the phasing at the point of convergence 70. If the two streams are desired to be a backbone to tail symmetry at the point of convergence 70 with a 50% out of phase between streams 1 and 2 and this does not exist at crawl speed, simply adjust the length of travel of one or both in the pitch enhancer section 120. Since the books of both streams are typically increased 300% or 400% in this section 120, a change of one inch in a length of travel of one pitch enhancer section will generate 3 or 4 inches of phasing adjustment between the two streams.

In terms of one preferred embodiment of the machine assembly of the present invention, reforming a single nested stream of books, shingled or not, into a single-file stream is exhibited in FIG. 7*a*, a top view schematic. The modules of the machine assembly required include the complete single path of streams 1 and 2 of FIG. 4A without the upper-merger section 160 and the upper pitch enhancer section 120. This preferred embodiment of the machine assembly of the present invention for its fifth purpose permits desertion of one nested stream, shingled or not, to one or two single-file streams by simply rotating table 82 tangentially as shown in FIG. 4A and FIG. 7*a*, respectively. Two point desertion uses the book-separator section 140 of the stream 1 path to tangentially deserted outer books 16 to 16 as shown in FIG. 7*a* of the incoming nested stream sets of books 16/18. In this case, books 18 to 18 travel straightforward and out to the book-separator section 160 of the path stream 2.

In this case, as shown in FIG. 4A, the pinning assembly 128 of table 82 is positioned, more or less, parallel to the primary pinning assembly 132 of the path of stream 2. The primary pinning assembly 132 of the lower-merger section 130 and the pitch-enhancer section 120 operate at the same higher surface speed Sp as shown in FIG. 7*b*. This opens the shingle pitch (P) of the nested books at point 60 to some desired higher value Pp at point 65. Take note that the backbone edges of the outer books 16 and inner book 18 are still against one another at point 65. At point 65, the outer books 16 are pinned by the upper-pinning assembly 128 on their protruding side-edge without trapping the inside edge of books 18 and moved 128 on their protruding side-edge without trapping the inside edge of books 18 and moved forwardly at a greater surface speed that the inner books 18. The objective of this higher relative surface speeds of the outer books 16 as compared to the inner books 18 is the cause each book of a set of books 16/18 to each arrive sequentially at the point of convergence 70 with a desired book symmetry.

In a preferred embodiment of the present invention, pinning assembly 128 is positioned pointing slightly toward pinning assembly 132 so that the sides of books 16 will line up with books 18 at the point of convergence 70. Please note on FIG. 7*b* that there is a distance between the end of upper pinning assembly 128/132 and point 70 of about one inch greater than the width of the book being processed to ensure that each book is clear of 128/132 nipping before being nipped by the higher surface speed of the book-separator section. The books symmetry at pint 70 exists so that the books 16 and 18 arrive at the book-separator section 140 at equal intervals of time. In section 140, the higher surface speed will reform books 16 and 18 alternately into a single-file stream with a set gap width between the tail end of the prior book and the backbone of the next book at the exit of section 140.

Alternatively, the nesting stagger of the books 16 and 18 (reminisce of the protrusion of book 18 out of book 16) may be eliminated by the use of conventional inline jogger machines. The preferred book symmetry of shingled books at the point of convergence 70 is created by increasing the shingle pitch at point 65 to 50% of the book width and advancing book 16 of each set by 50% of the width of a book in relation to its book 18 at the point of convergence 70. With this book symmetry at point 70, except for the first and last set of books 16/18, the books enter the book separator 140 in sets of two (i.e. book 16*b* squarely upon book 18*a*). This book symmetry generates an acceptable single stream of books for further processing and allows the machine assembly of the present invention to handle twice the press speeds or to operate at half the surface speeds. Press speed is the single most important issue in web printing. Please note that it might be practically advisable to set the surface speed of pinning assembly 128 about 5% slower than it would be required to result in a perfect pairing at point of convergence 70. In this way, the piggyback book 16*b* will be slightly behind book 18 a to result in good order exiting section 140. Nonetheless, this book symmetry is preferred since it permits higher press speeds.

To provide a better understanding and appreciation for the true value of the machine assembly of the present invention, the relative speeds required to generate a desired book symmetry at the pint of convergence 70 and at the exit point 80 of the book separator section 140 are mathematically determinable in all embodiments of the machine assembly of the first five purposes. As an example only, the following is to generate the formula to receive the shingled nested books 16/18 of FIG. 7*a* to result in a single shingled stream after shingling in the flyless section 150. Let us assume that both pitch-enhancer sections and the primary pinning assembly 132 are driven by one full vector drive/motor set "a". Let us also assume that pinning belt assembly is driven by full vector drive/motor set B as the book separator sections 140 is driven by set "C" and the exiting conveyor assembly of the flyless shingling section is driven by set "D". The object of deriving accurate relative speed ration formulae from drive A to D is so that each drive can be set as a ratio of the surface speed of the books issued from a press run.

Referring to FIG. 7*b*, assume the nested books arrive at pint 60 with a shingle pitch Pe and travel at surface speed Se. Next assume that the books 16/18 will enter and exit in stream path as shown in FIG. 7*a* and, of course, upper pinning assembly 128 is parallel to upper pinning assembly 132. If it is desired to increase the shingle pitch from Pe to Pa between point 60 and 65 books 16/18 set A will travel a distance Pa at surface speed Sa (the speed of the pitch-enhancer section 120 caused by drive/motor set A). Since time equals distance divided by surface speed, $$T = \frac{Pp}{Se} = \frac{Pe}{Sp}$$

$$\therefore Sp = \frac{Pp}{Pe} \times Se$$

However, the surface speed of the incoming stream and any conveyor speed is equal to the RPM's of its pulley and its belting $$\left(\prod De\right)$$

$$Se = RPMe \times \left(\prod De\right)$$

$$Sa = RPMa \times \left(\prod Da\right)$$

$$\therefore RPMa \; \frac{Pa}{Pe} \; \frac{De}{Da} \times RPMe$$

However, RPMe is the RPM's of the pulley of the conveyor feeding our pitch-enhancer section 120 as RPMa is the RPM's of the lower pinning assembly pulley of our pitch-enhancer section 120.

If the motor set A is connected to the pitch-enhancer section 120 using toothed timing chains, the RPM's of motor A will Be:

$$\text{RPM motor a} = \frac{RPMa \times \text{Teeth \# of Conveyor Sprocket}}{\text{Teeth \# of \# Motor Sprocket}} \qquad \text{(Formula 1)}$$

$$= \frac{Pa}{Pe} \times \frac{De}{Da} \times \frac{\text{Teeth \# of Conveyor Sprocket}}{\text{Teeth \# of Motor Sprocket}} \times RPME$$

Since, Pe, De, Da and both Teeth #'s are known values. The RPM's of Motor A is a direct ratio relationship to the desired pitch numerical value Pa at all values of Se.

To determine the speed ratio of the upper pinning assembly 128 to the incoming surface speed, assume the distance between point 65 and 70 is "1" and the surface speed of 128 is Sb. Now, assume that the time that the other book 16*a* travels a distance L at surface speed Sb, the inner book 18*a* must travel a distance of L less an effective Pitch of Pep at surface speed Sp.

Again the simple formula applies:

$$\text{Time} = T = \frac{L}{Sb} = \frac{L - Pep}{Sp} \qquad \text{(Formula 2)}$$

$$\therefore Sb = \left(\frac{L}{L - Pep}\right) Sp$$

$$\text{But, } Sb = \text{RPM conveyor b} \times Db \times \prod$$

$$Sp = \frac{Pp}{Pe} \times Se \text{ (see above)}$$

$$= \frac{Pp}{Pe} \times Se$$

$$\therefore \text{RPM conveyor 128} \times Db \times \prod = \left(\frac{L}{L - Pep}\right) \frac{Pp}{Pe} \times Se$$

$$= \frac{L}{L - Pep} \times \frac{Pp}{Pe} \times RPMe \times \prod \times De$$

$$\therefore \text{RPM conveyor 128} = \left(\frac{L}{L - Pep}\right) \frac{Pp}{Pe} \times \frac{De}{Db} \times RPMe$$

$$\text{RPM motor b} = \frac{L}{L - Pep} \times \frac{Pp}{Pe} \times \frac{De}{Db} \times \frac{\text{Teeth \# of conveyor 128 Sprocket} \times RPMe}{\text{Teeth \# of Motor Sprocket}}$$

Since L, Pp, Pe, De, Db and both sprocket sizes are known RPM motor b is a direct speed relationship to the desired numerical value of Pep for all values of Se. Similarly, to determine the value of the surface speed of the book separator section 140, book 16*a* must travel a distance equivalent to the width of book (w) plus the length of the desired gap (g) at the exit of section 140 at surface speed Sbp in the same time that book 18*a* must travel a distance of Pep at surface speed Sp.

$$\text{Time} = T = \frac{W + G}{Sbp} = \frac{Pep}{Sp} \qquad \text{(Formula 3)}$$

$$\therefore Sbp = \frac{W + G}{Pep} \times Sp$$

$$\text{But, } Sp = \frac{Pp}{Pe} \times Se \text{ (See above)}$$

$$\therefore Sbp = \frac{W + G}{Pep} \times \frac{Pp}{Pe} \times Se$$

$$\text{But, } Sbp = RPMbp \times Dbp \times \prod$$

$$\text{And, } Se = RPMe \times De \times \prod$$

$$\therefore RPMbp = \frac{W + G}{Prp} \times \frac{Pp}{Pe} \times \frac{De}{Dbp} \times RPMe$$

$$\text{RPM motor c} = \frac{WG}{Pep} \times \frac{Pp}{Pe} \times \frac{De}{Dbp} \times \frac{\text{Teeth \# Conveyor } bp}{\text{Teeth \# Motor c sprocket}} \times RPMe$$

Since W, Pp, Pe, Pep, De, Dbp and Teeth counts are known the RPM's of Motor C is a direct speed relationship to the desired numerical value of G for all values of Se.

For simplicity, let us know assume that the desired book symmetry at point 80, the exit of the book-separator section 140, is a single-file stream with a gap equal to half the width of a book W. Let us further assume that L equals 30 inches and Pep is also half a book and that Zpe is 2.5 inches and Pp is 5.0 inches and the book width is 10.0 inches. Also assume that all conveyor pulley diameters and the motor and conveyor sprockets are also the same.

Using Formula 1

$$\text{RPM Motor A} = \frac{5.0}{2.5} \times \frac{1}{1} \times \frac{1}{1} \times RPMe = 2.0 \times RPMe$$

Using Formula 2

$$\text{RPM Motor B} = \frac{30}{25} \times \frac{5.0}{2.5} \times \frac{1}{1} \times \frac{1}{1} \times RPMe = 2.4 \times RPMe$$

Using Formula 3

$$\text{RPM Motor C} = \frac{10+5}{5} + \frac{5.0}{2.5} \times \frac{1}{1} \times \frac{1}{1} \times RPMe = 6.0 \times RPMe$$

With regard to Motor d, the drive for the exiting conveyor of the flyless shingler section 150 and if it is desired to result with a 2.5 inch shingle pitch of the existing single shingled stream, there are twice the books being issued per linear foot at the exit than at the entrance at point 60 and therefore Motor d must run at twice the speed.

Therefore Motor d=2.0×RPMe

Indeed, the above speed calculations for the fifth purpose, reforming nested books into a single-file or single shingled stream are the most complex of all five merging purposes of the machine assemblies of the present invention. Given these calculable relative speeds, it follows that if we chose a fixed numerical value for Gap "G", a desired book symmetry at the pint of convergence 70, relative speeds are easily programmed in advance so that the machine assembly can be run automatically but for slippage. However, tests have shown that slippage can be totally eliminated or made constant such that it does not impact on the above equations. Further, the machine assembly can be ramped in speed faster than the press speed is ramped to say 20% of the presses maximum speed since all books produced to that base press speed are typically sent to waste. In this way, the gap "G" will be greater than the set value for G until the press-speed catches up. This use of the gap "G" to stabilize the operation of the machine assembly of the present invention is interesting since full vector motors/drive operate more efficiently at higher RPM's by generating a more constant torque. This quick ramping extends the life of the drive/motor sets and permits greater over all accuracy of speed relations.

Figure 8:
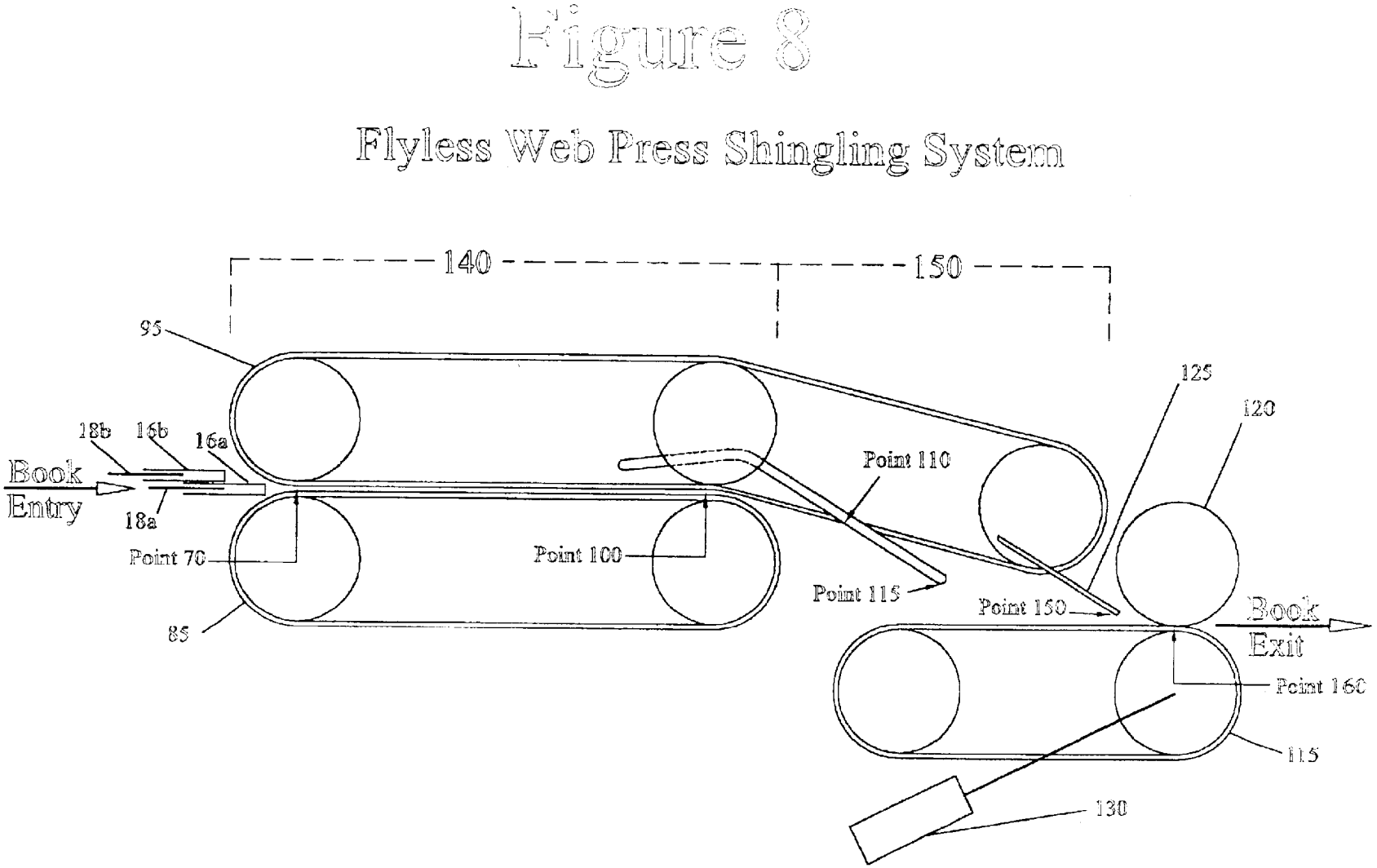
FIG. 8 is a side view of a wireless web press shingling section.

The above descriptions deal with the reformation of the book streams of the first five purposes of the present invention in a single-file stream of books with a desired book symmetry at the exit of the book separator sections. However, the preferred embodiment of the machine assembly of this present invention includes its final section, the flyless shingler section 150, as shown in FIGS. 7*a* and 7*b* schematics. FIG. 8 is a side-view schematic of a flyless shingler section 150 abutted against book-separator section 140 with a stream of nested books 16 and 18 entering it. Here, the point of convergence 70 is shown as being the entry point 79 of the book separator section 140. At point 70, each book in a sequential order of 16, 18, 16, 18, and so forth, are nipped sequentially by the upper 95 and lower pinning assembly 85 of the book-separator section 140 at a higher surface speed than the books exiting the prior section, the lower-merger section 130, at the point of convergence 70. In passing, the upper pinning assembly 95 and lower 85 could be conveyor 20 and 40, respectively, of a folder machine as shown in FIG. 2. In the first preferred embodiment of the book separation section 140 of FIG. 8, pinning belt assembly 95 extends beyond the lower pinning assembly 85 and slopes downward so that the books issued from point 100 will be directed downward on the underside of the belts of pinning belts 95. Pinning belts 85 and 95 are preferably a matched parallel set of individual flat belts running on crowned wheels, instead of conveyor roller cylinders, each belt being about one inch in width and separated from each other by approximately 4–6 inches. This dual set of belts 85 and 95 of the book separator section 140 is to avoid book skewing while imparting increased surface speed to the backbone edge of each book, one after the other, at an equal increment of time. Accordingly, the design of the nipping pressure control of the upper pinning assembly 95 is important to this present invention so that each book passes smoothly and squarely independent of book thickness and the absence of thickness due to the gaps this section exists to create. If this first design of the book separator section 140 is preferred in a given application, the distance "u" is ideally less than the distance "1" so that the upper pulleys 96/97 will not ride on the lower pulleys 86/87. This means that chatter and vibrations are greatly reduced and the nipping pressure on the books is more steady and constant. Indeed, pulley 96/97 may be a single pulley situated near pulley 96 as shown in FIG. 8 except that this single pulley is slightly further down stream so that its vertical centre-line is forward of the vertical centre-line pulley 86. In the case of pulley 97/87, 97 will be before the vertical centerline of 87. Indeed, pulley 96/97 could be replaced by one pulley placed in any location between pulley 86/87. The idea of this riding of belt 95 on belt 85 where support is only provided by elastic belt 85 is to provide for quiet self-alignment without requiring much nipping pressure.

Each book 16 and 18 sequentially are issued from point 100 so that the upper face of each book is pinned against the underside of belts 95 until after its forward backbone edge meets stripping fingers 105. These stripping fingers 105 are fixed smooth prongs placed between the belts 95 at a steeper slope from the horizontal than the slope of the over-hanging belts 95. Starting at point 110, the stripping fingers 105 cause the backbone edge and portion of a first book to descend downwards more steeply (between point 110 to 115) while the rear portion of that book is also pinned to the underside of the belts 95 (between point 100 to 110). Ideally, the backbone edge of this first book should be touching the top surface of the prior book on exit conveyor 115 when the tail end of that first book is released from point 100. Prior to being released from point 100, this first book is pinned on the underside of belts 95 and the stripping fingers 105 by the natural vector force created by downward motions imposed upon it. Despite friction and air turbulence, the aforementioned forces keep the first book and its loose pages at its tail in a pre-defined spatial location while moving forward and downward. When the tail of the first book becomes free from the nipping control of point 100, the backbone edge of the second book has yet to arrive at point 100 since at that instant, the gap "G" exists and both books move at the same surface speed. At this instant, the first book is not longer driven forward and it starts de-acceleration. However, the second book is not de-accelerating. Simultaneously, the second book moving at the surface speed of the book-separator section 140 starts to close the gap width between its forward backbone edge and the tail end of the first book.

Meanwhile, the backbone edge of the first book upon conveyor 115 is continuing to decelerate aided by the gentle pressure applied upon its top surface of the prior book on conveyor 115 at point 150 by combing fingers 125. When the backbone edge of the first book is again nipped and controlled by nipping assembly 120 at point 160, the tail end of this first book is still against the stripping fingers 105 between points 110 and 115. When the backbone edge of the first book is nipped at point 160, its tail end, using points 140 and/or points 150 as fulcrum lines, is forced downward by the slight nipping thrust applied on it at point 160. This thrust action causes the tail end pages of this first book which are held securely against the underside of the stripping fingers 105 to move counter clockwise as a single mass using points 140 as the centre of rotation (fulcrum line) meanwhile, the backbone edge of the second book may have caught up or passed the tail end of the first book.

If the more rigid forward backbone edge of the second book is beyond on the tail end of the first book, it will be below the tail end of the first book. This is an incorrect book orientation since the shingling convention requires that the backbone of the second book is deposited on the topside of the first book on conveyor 115. However, the nipping thrust applied on the first book by the nipping control point 160 causes its tail end pages to sweep past the forward more rigid backbone edge of the second book which is also held in a steady position by its pinned status at point 100. This sweeping action witnessed in quality and quantity by a strobe-light instrument permits the tail end of the first book to sweep past the backbone edge of the second book at high production speeds to create the correct orientation of two sequential books on conveyor 115. In terms of practicality, this thrust action permits higher press speeds without product jams in the process of the flyless shingler section 150.

More importantly, higher product speeds is a prime objective of this present invention. The use of the sloped belts 95, stripping fingers 105 and combing fingers 125 are the first preferred embodiment of the machine assembly of the present invention because the design is easily adaptable to folder machines to replace their fly shingler apparatus. As a replacement for fly shinglers, the books, nested or not, are already in a single-file stream as if they had been reformed into a single-file stream by the book-separator section 140. Accordingly, the flyless shingler section of the machine assembly of the present invention includes all mechanical means and methods that controls sequential books by first utilizing its downward vectored force depicted by belts 95 and/or transitioning them more downwardly depicted by stripping fingers 105 and/or applying nipping thrust fulcrum action depicted by pinning assembly 115/120.

A very significant alternative machine design is the second preferred embodiment of the book-separator/flyless shingler sections as shown in FIG. 9. The purpose of two preferred embodiments is due to the nature of book productions. Some books are made of silicone impregnated paper stock. Some are made from very light paper stock such as 30–34 lbs. SCA (super calendared grade A stock). The latter books tend to react poorly flight. Also very large books tend to react like light stock books even when they are thicker or impregnated with silicone.

Figure 9A:
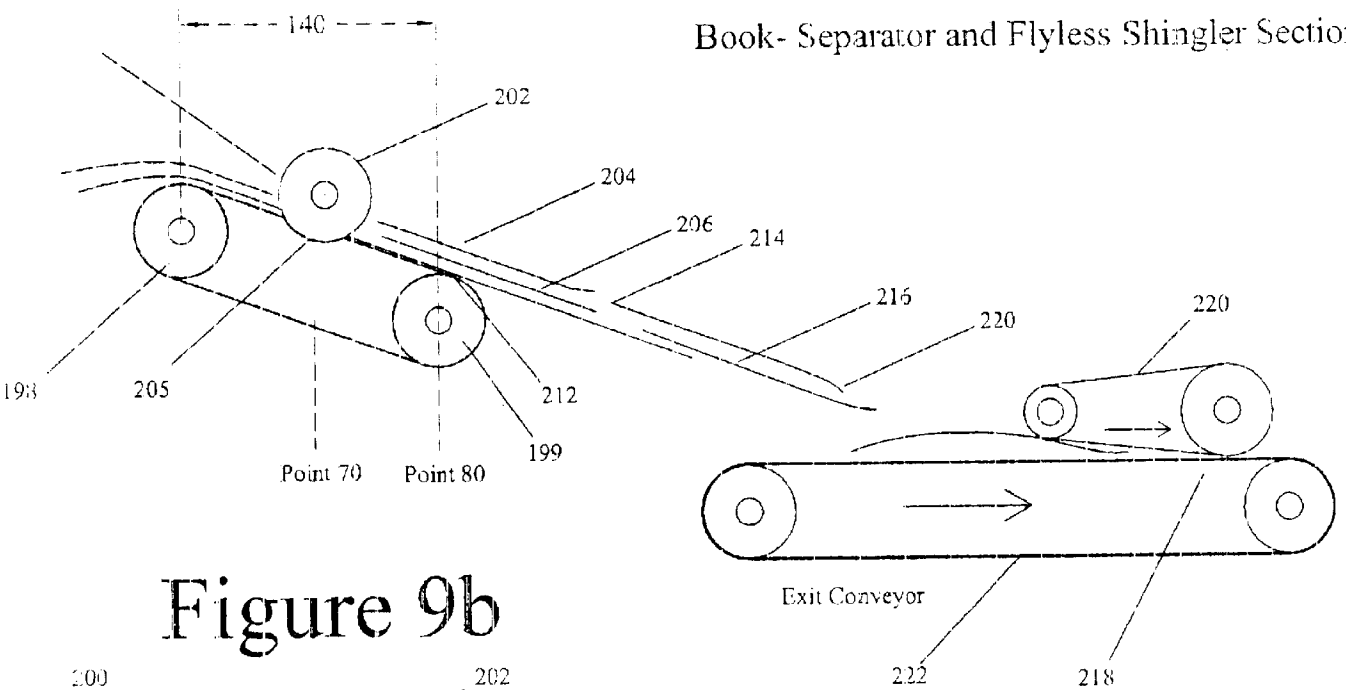
FIG. 9*a* is a side view of a book separator and flyless shingle section.
Figure 9B:
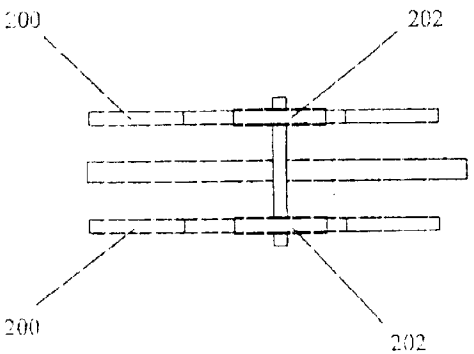
FIG. 9*b* is a top plan view of a portion thereof.

In some cases, it was found that it is desirable to physically limit the freedom of each book to eliminate random book flutter. For these cases, FIG. 9*a* is a schematic side view of the alternative design. In this alternative design, the flutter control being more important that the vectored controlling forces of the first design, the slope of the book separator section is very much reduced. In place of the greater vectored force, each book is sandwiches between upper and lower plates with openings where the lower pinning assembly belts 200 protrude to mate with the upper pinning assembly. The lower pinning assemblies consist of two one-inch belts each mounted on two solid anodized aluminum wheels. These anodized aluminum wheels are crowned such that the center of the wheel circumference is about 0.5 inch wide and raised above the quarter of an inch on either side. The two sides of 0.5 wide flat surface of each wheel are sloped to the sides of the wheel so that the belt is contoured against the wheel. The belt material is elastic and rubber based of know art such a Hibisit Belting to permit about eight to ten wheels whose belt length without tension could be 20 inches. The belt circumference for the lower pinning belt is preferably 20 to 24 inches since length is not critical. This lower pinning assembly is also slipped downward in the forward direction of approximately 10 degrees. The upper pinning assembly 202 is the same wheel on which the same elastic belt is applied under 6 or 7 percent tension. Further, there are two lower belt assemblies acting as one rigid unit with two adjacent free turning wheels 198 before point 70 and two driven wheels 199 at point 80. Also, there are two upper pinning assembly wheels acting as one rigid unit where the wheels 202 are free turning around a stationary axial and about 4 to 6 inches apart. The tandem upper pinning wheels are held in a fixed position against the upper surface of belt 200 and the weight of this upper assembly depresses the belt 200 slightly. The depression into belt 200 is easily controlled by a counter weight on the assembly that holds the axial of wheels 202 in a fixed location as shown in FIG. 9*b*. To guide each book past the nipping point 205, there is an upper sandwich plate 204 and a lower sandwich plate 206.

Immediately after the backbone of the first book exists this sandwich arrangement, there is a series of stationary fingers 208. These fingers 208 are preferably flat strips about 0.5 inch wide spaced by 0.25 inch to form a supporting face to prevent each book from distorting upwards. Said fingers 208 are placed such that a straight line is formed by points 205, 214, 216 and 218. However, point 220 at the tip of the fingers 208 slightly deflects each book downwards such that each book is subject to a sine-wave sloping under the exit nipping assembly caused by the redirection of each book by point 220 and caused by the thrust from nipping assembly 220 at point 218 that using points 220 as a fulcrum lines causes the tail of the first book to thrust downwards so that the backbone of the second book will be above the tail end of the first book. The exiting nipping assembly 220 consists of two wheels, a larger one forming point 218 with the exiting conveyor belt and a smaller one near point 220. This nipping assembly 220 is a system of two belts just like wheels 202 and rides slightly depressed into the exiting conveyor 222 just like wheels 202 rides on belt 200. Similarly, nipping assembly 220 is passive and not driven whereas conveyor 222 is driven. This sloped belt of nipping assembly 220 aids to remove the sine-wave shape out of the books as each exits the machine assembly of the present invention.

Figure 10:
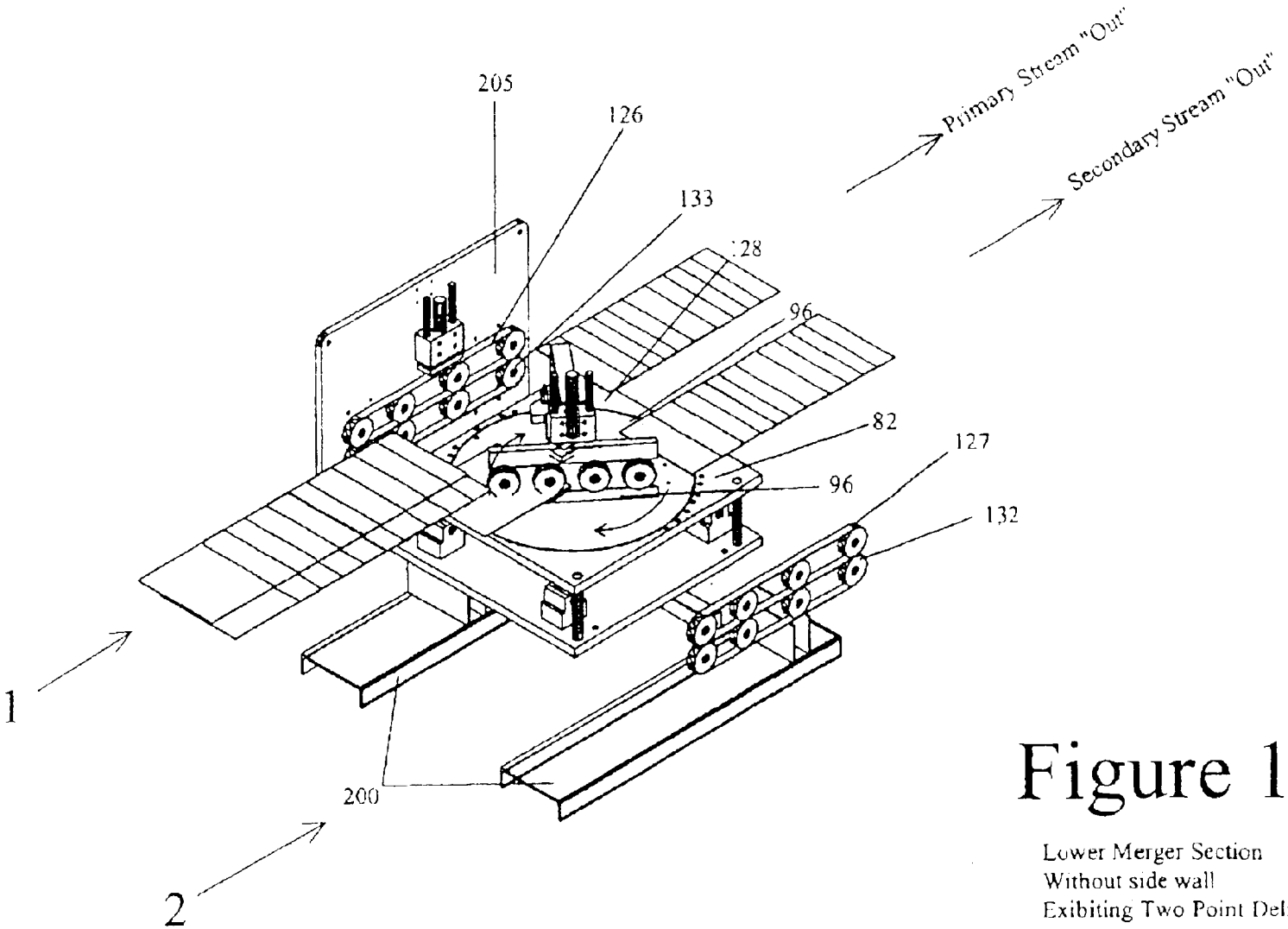
FIG. 10 is a perspective view of a lower merger section with portions thereof being removed for purposes of clarity.

For the purpose, the desertion of nested books into two separate streams (rather than one single stream of books of the fifth purpose of the present invention), the lower-merger section 130 is utilized as a stand alone system as shown in FIG. 10. As previously described and shown in FIG. 4A, this lower-merger section 130 has two primary upper-pinning assemblies 126 and 127 driven by one Full-Vector motor/drive. Also, this section 130 has one secondary upper-pinning assembly 128 driven by its own Full Vector motor/drive. In this way, nested books can enter on stream path 1 of FIG. 4A so that the primary inner book of each set are conveyed straight through under upper-pinning assembly 126 while the secondary stream is moved tangentially toward stream path 2 by clockwise rotating the articulated pinning assembly 128 by 45 degrees from the position shown in FIG. 4A. Conversely, the nested books can enter stream path 2 where the secondary books are moved tangentially toward path 1 by the rotating articulated pinning assembly 128 counter-clockwise by 45 degrees from the position shown in FIG. 4A. If the nested books are already shingled at entry point 65 of the lower-merger section, and two separate shingled stream is the desired existing form, there is no need to utilize the pitch-enhancer, the book-separator/flyless shingler sections 120/140/150. If the nested books are a single-file stream at entry pint 60 and it is desired to result in two exiting shingled streams, the two sets of book-separator/flyless shingler sections 140/150 must be utilized.

If the application for the lower-merger section is to use it as a two point deserter for nested books without changing their single file or shingled stream arrangement, the lower merger section only requires one or the other of upper pinning assembly 126j/127 and one full vector motor/drive system to desert to two points, left or right using a specific tangential angle for the secondary stream. For this purpose, the preferred tangential direction of travel of the secondary upper pinning assembly 128 is 45 degrees from the primary direction. In this case, one full vector motor/driven system is mounted to the table 82 of the secondary stream where the shaft of this motor is horizontal rather than vertical as shown in FIG. 5. This horizontal drive shaft of motor 80 is coupled to a three way gearbox (one input coupled to the motor and two output shafts). The vertical output shaft of the gearbox drives the secondary pinning assembly 128 in the same manner as shown in FIG. 5 at a 1.51 to 1 ratio to the motor 80. The second output shaft and motor drive shaft are oriented in the same primary lower pinning assembly 127 by a telescopic shaft. As the table assembly is manually moved towards or away from the primary pinning assembly to suit the book sizes, using worn-gear 87; the telescopic shaft deals with the increase or decrease in space between the primary and secondary pinning assemblies.

Whereas U.S. Pat. No. 4,477,066 issued to Rudolf Fischer et al on Oct. 16, 1984 permits separating nested shingled books into two streams (called two point delivery), the present invention permits one or two point delivery on an alternating basis without length change over periods. This is important to provide a means to print dissimilar books simultaneously so that the outer book is are moved tangentially by the secondary pinning assembly 128 to the path 2 to result in two steams, each delivered to their respective stacker/trimmer/staff. Alternatively, the printer can print similar books simultaneously and deliver both to one stacker/trimmer/staff.

Apart from this, the lower-merger section is a stand-alone two point deserter system that facilitates right or left-handed desertion using the same machine assembly. This is important since floor space limitations and the physical size of stackers/trimmers often prevent desertion in one or the other directions. FIG. 10 exhibits the lower-merger section as a stand-alone two-point deserter using two full vector motor/drives, one for the articulated pinning assembly (secondary) 128/96 and one for the two primary pinning assemblies (126/133 and 127/132). In this case, the secondary stream vector motor is mounted vertically as in FIG. 5 and the primary vector motor is mounted A the u-beams such that its output shaft is oriented perpendicular to lower pinning assembly 132 or 133 and connected to 132 or 133 by a toothed timing belt/sprockets. If 132 was directly driven, one of the sprockets of lower pinning assembly 133 is at the other end of the same shaft that drives the sprocket of 132. Preferably, these lower pinning assemblies consist of two tooted timing sprockets, one at either end of a one inch wide belt such as a Goodyear timing belt covered with an additional ¼ inch layer of Lino tex material so that the top belt travels horizontally without sagging, two or more full aluminum wheels about one inch wide run freely between the two timing sprockets such that the teeth of the timing belt ride in their outer circular surface. With this design, nested books may enter as a stream 1 with the secondary book on the side of stream 2. The primary pinning assembly 126/133 may be set to follow the press speed and the secondary pinning assembly 96/128 may be set to a faster speed to provide a forward surface speed that is 5%, or so, faster than the primary surface speed at whatever tangential angle desired. This is right hand two-point desertion. However, if left-hand desertion is required, the nested books enter as stream 2 and the outer secondary books are deserted towards stream 1.

The aforementioned allows right or left desertion at a tangential angle to the primary of approximately 10 to 75 degrees (say 45 degrees), then the pinning assembly 126/133 or 127/132 could be eliminated as well as one of the two full vector motors. Assuming pinning assembly 127/132 is eliminated nested books enter stream 1 as explained above where the tangential angle is fixed at say 45 degrees. In this case, the vector motors horizontal and mounted to the underside of table 82 and the secondary stream are driven by the vertical output shaft of a 3 way gearbox. Also, the horizontal output shaft of the gear-box on the opposite side to the input gear shaft (coupled to the motor) is coupled to a telescopic shaft which in turn is coupled to a stationary toothed trimming sprocket that drives lower pinning assembly 133. This telescopic shaft is nothing more than a shaft riding inside another hollowed out shaft where one and the other are fitted with a male/female key way 12 to 14 inches in length. As table 82 is moved perpendicular to the primary flow of books using the work gear 87 of FIG. 9 to accommodate the book width (7 to 19"). The telescopic shaft permits this sideways motion. This telescopic shaft can be accomplished using a spindle shaft as is common practice with farming equipment or any other mating shapes, i.e. triangular that permits lateral movement between the two yet causes the two to rotate as one around the centre point of the lateral line of movement. IN the preferred embodiment of the lower-merger section as a stand-alone two-point desertion system, the tangential angle "Ø" may be any value desired. Assuming that it is desired to be 45 degrees and the forward speed of the secondary is also desired to be 5% higher than the primary surface speed Sp, the surface speed of secondary lower pinning assembly (Sa) is:

$$\frac{Sa = Sp}{\text{Sin } 45} = \frac{1.05 \text{ SP}}{\text{Sin } 45}$$

Of course, the above will provide right hand desertion. If left-hand desertion is required, this machine assembly is rotated on its four casters by 180 degrees. Now stream 2 is left of stream 1. If the pinning assembly 96/128 is rotated nineth degrees counter-clockwise and the full vector motor/ drive is put in reverse, this machine assembly becomes a left-hand deserted without any inconvenience.

In order to make this machine assembly more efficient, industrially, motor driven hydraulic legs raise the deserting platform to the correct altitude that would otherwise be resting on the floor on four caster wheels. Slightly higher than the casters, there are two upside down u-beams 200 welded into place so that machine assembly may be transported by lift truck throughout a given plant. The preferred embodiment of the present invention also includes new means to discharge primary and secondary books from the machine assembly of this lower-merger system being run as a two-point deserter. FIG. 11 is an isometric schematic exhibiting the tangential flow of secondary books. Assume a shingled nested stream of books enter at stream position 1 of FIG. 10 as shown graphically in FIG. 11. The primary stream iout is fully pinned by upper pinning assembly 126 as the tangential secondary stream is pinned by 128. Since the primary stream does not change directions, the primary stream out is easy to establish and maintain on the existing conveyor system supplying the subsequent trimmer/stacker equipment. However, the secondary stream is full secured under upper pinning assembly 128 and flows in a precise orderly fashion during its full tangential traverse until a given secondary book is released from the pinning assembly 98/128. Upon being released the book is travelling tangentially when it is then desired that it travels forwardly only. In U.S. Pat. No. 5,597,156, it is taught that this vectored travel direction may be converted into a useful force that pins the right side of each book against a fence aligned on the right side of the forwardly direction, if each book is simultaneously bumped at the fence and moved forwardly by a conveyor at the forwardly surface speed at the primary stream (or up to 5% more). Unfortunately, this prior art requires a stationary fence abutted to a moving conveyor. While this was found to be effective, the potential of book jam and/or damage to this exit conveyor belt are present and possible. To overcome this negative, the present art includes the use of a pair of face rotating wheels (not driven) 210 held squarely in place so that two points of each book along its backbone. Edge is nipped simultaneously. This pair of wheels are held in place and fixed to the machine assembly side frames. In this way each book is perfectly square upon release from the pinning assembly 96/128 and effectively handed over to the free rotating wheels 210 resting on the exiting conveyor. The present invention includes that the forwardly surface speed of the tangential books is precisely the same as the exiting forwardly conveyor on that the book is pinned by the points, this nipping action is more than sufficient to absorb the sideward thrust.

With regard to stream diversion, that is, moving a stream into a parallel or tangential direction to its original direction without changing the book orientation, FIG. 11 and the above discussion applies. The only added issue is to re-direct the secondary stream (the only stream in this case 0 using the paired free rotating wheels is that the incoming stream may be at different angle than 45 degrees to the tangential stream to issue the diverted stream in a parallel stream orientation to the incoming stream. In this way, the two nipping points of the wheels 210 is always and necessarily perpendicular to the flow of books so that each book is nipped simultaneously.

With regard to the bump-turn purpose for the lower-merger section, the exiting books are nipped on the side edge of the book by paired wheels riding on a conveyor running away at ninety degrees to the incoming stream. In this case, the books will be travelling away with their right side edge forward so that the tail end of the books will be exposed in a straight line for trimming.

It will be understood that the above described embodiment is for purposes of illustration only and that changes or modifications may be made thereto without departing from the spirit and scope of the invention.

We claim:

1. An apparatus to reform two internally symmetrical single-file streams of copies, one above the other, which are symmetrical with each other, into an enhancer section, an upper-merger section, a lower pitch-enhancer section, a lower-merger section and a book-separator section so that the copies of the upper stream may be deposited sequentially between the copies of the lower stream to form a single symmetrical stream from which each copy may be delivered to the entry pint to a higher speed book-separation section in equal intervals of time along with the means to control and monitor the gap between the single file copies issued from the latter section, where each section of the machine assembly is driven by a constant torque full vector motors/drives except the lower merger section that is driven by two such motors/drives.

* * * * *